US007574841B2

(12) United States Patent
Knepp et al.

(10) Patent No.: US 7,574,841 B2
(45) Date of Patent: Aug. 18, 2009

(54) METHOD OF ERECTING A WALL HAVING A VERTICALLY ADJUSTABLE HINGED SUPPORT COLUMN

(75) Inventors: Wayne A. Knepp, Morton, IL (US); Tim Wetterhus, Morton, IL (US); Don Ferguson, Pennsylvania Court, IL (US); Dave Fehr, Morton, IL (US); Paul Remmele, Morton, IL (US); John Gleason, Morton, IL (US)

(73) Assignee: Morton Buildings, Morton, IL (US)

( * ) Notice: Subject to any disclaimer, the term of this patent is extended or adjusted under 35 U.S.C. 154(b) by 0 days.

(21) Appl. No.: 11/861,898

(22) Filed: Sep. 26, 2007

(65) Prior Publication Data

US 2008/0072529 A1 Mar. 27, 2008

Related U.S. Application Data

(60) Division of application No. 10/917,901, filed on Aug. 13, 2004, now Pat. No. 7,343,713, which is a continuation-in-part of application No. 10/794,905, filed on Mar. 5, 2004, now Pat. No. 7,275,351.

(60) Provisional application No. 60/452,897, filed on Mar. 7, 2003, provisional application No. 60/494,690, filed on Aug. 12, 2003, provisional application No. 60/526,839, filed on Dec. 4, 2003.

(51) Int. Cl.
*E04B 1/20* (2006.01)

(52) U.S. Cl. ..... 52/741.15; 52/126.1; 52/297

(58) Field of Classification Search ..... 52/169.9, 52/169.8, 169.1, 169.4, 169.13, 741.15, 741.14, 52/745.17, 745.18; 405/230
See application file for complete search history.

(56) References Cited

U.S. PATENT DOCUMENTS

| | | | | |
|---|---|---|---|---|
| 2,403,080 | A | | 7/1946 | Hilborn |
| 3,108,403 | A | * | 10/1963 | Jackson ..... 52/169.9 |
| 3,494,092 | A | | 2/1970 | Johnson et al. |
| 3,593,482 | A | | 7/1971 | Johnson |
| 3,671,738 | A | * | 6/1972 | Beachley ..... 362/431 |
| 3,797,793 | A | | 3/1974 | Moritz et al. |
| 3,837,127 | A | | 9/1974 | McMichael et al. |
| 3,971,185 | A | * | 7/1976 | Hendrich ..... 52/745.14 |
| 4,111,217 | A | | 9/1978 | Victor |
| 4,125,975 | A | | 11/1978 | Soble |
| 4,217,738 | A | * | 8/1980 | Smith ..... 52/40 |
| 4,368,602 | A | | 1/1983 | Manten |
| 4,417,424 | A | | 11/1983 | Jacobson |
| 4,462,197 | A | | 7/1984 | D'Alessio et al. |
| 4,479,333 | A | * | 10/1984 | Hendrich ..... 52/70 |
| 4,481,748 | A | | 11/1984 | D'Alessio et al. |

(Continued)

*Primary Examiner*—Brian E. Glessner
*Assistant Examiner*—Adriana Figueroa
(74) *Attorney, Agent, or Firm*—Howard & Howard Attorneys PLLC

(57) ABSTRACT

A height adjustable jack piling assembly has a piling with a top and a bottom. A hinge axis is disposed on the top and a bearing plate is disposed at the bottom. A height adjustment mechanism extends upwardly from the bearing plate and through the piling to raise the piling, and the corresponding hinge axis, by operating the height adjustment mechanism from the top. The method includes placing a jack piling assembly and second lower piling, each having a hinge axis, into the earth and operating the height adjustment mechanism of the jack piling assembly to align the hinge axes.

11 Claims, 37 Drawing Sheets

U.S. PATENT DOCUMENTS 4,546,581 A 10/1985 Gustafson
4,598,510 A 7/1986 Wagner, III
4,662,146 A 5/1987 Parry
4,715,159 A * 12/1987 Hijazi ..... 52/646
4,866,797 A 9/1989 Vollan
4,878,160 A * 10/1989 Reneau et al. ..... 362/269
5,232,204 A 8/1993 Nunez
5,347,949 A 9/1994 Winston
6,216,414 B1 * 4/2001 Feldberg ..... 248/525
6,503,024 B2 * 1/2003 Rupiper ..... 405/230
2002/0007613 A1 * 1/2002 Gordin et al. ..... 52/726.4
2003/0167727 A1 * 9/2003 Peng et al. ..... 52/741.14

* cited by examiner

FIG - 12
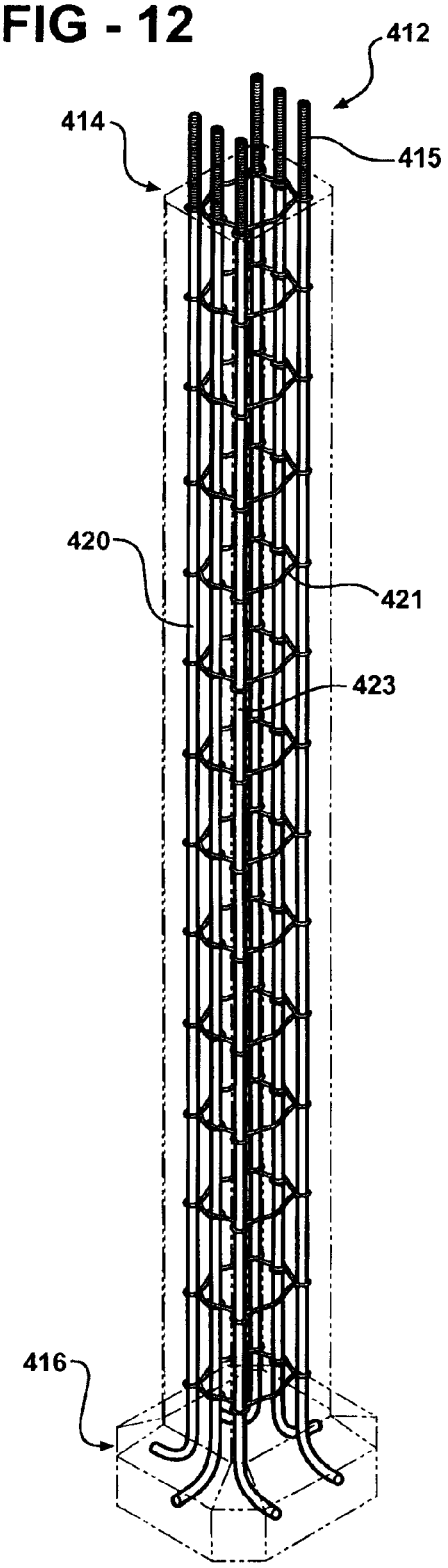
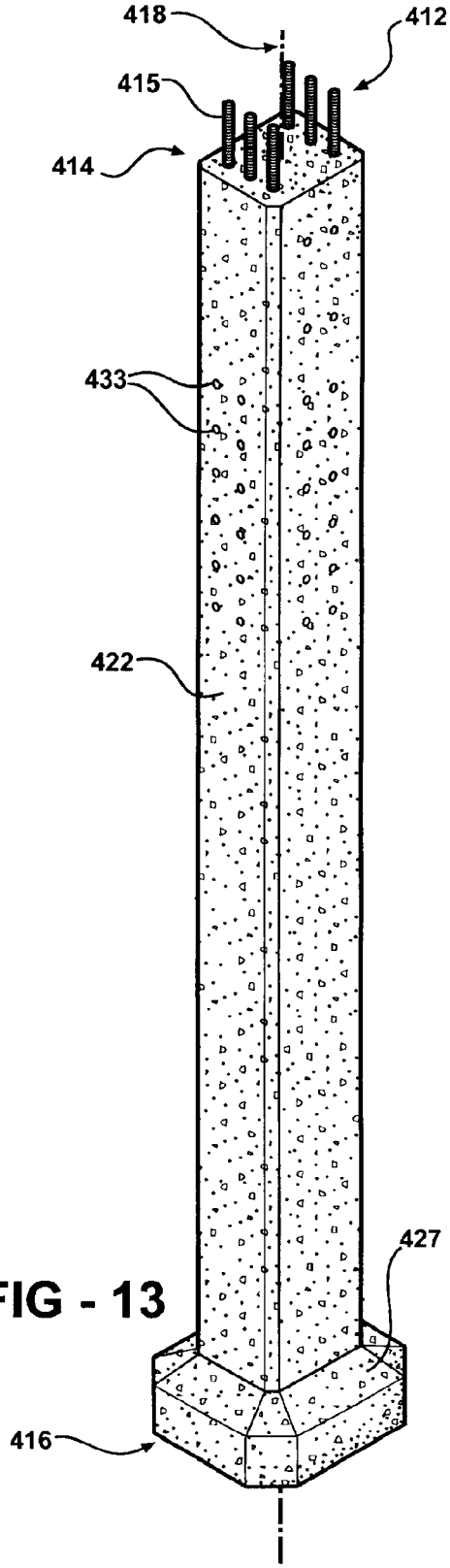
FIG - 13

FIG - 14
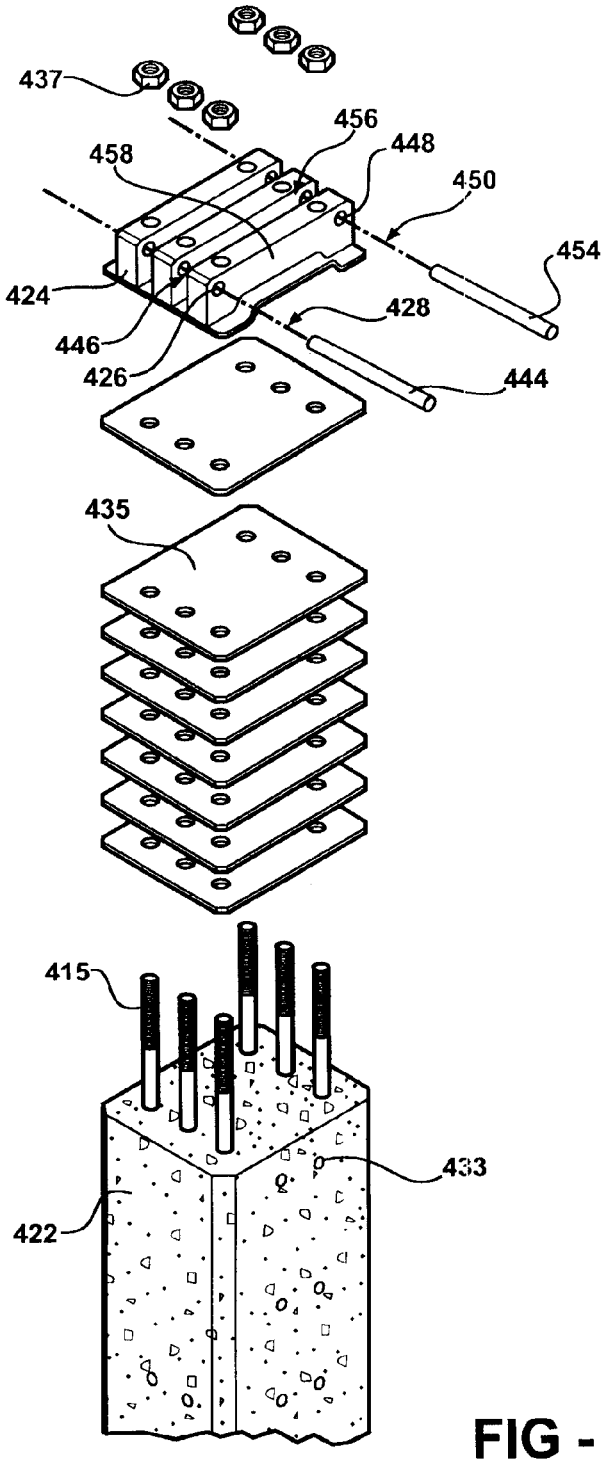
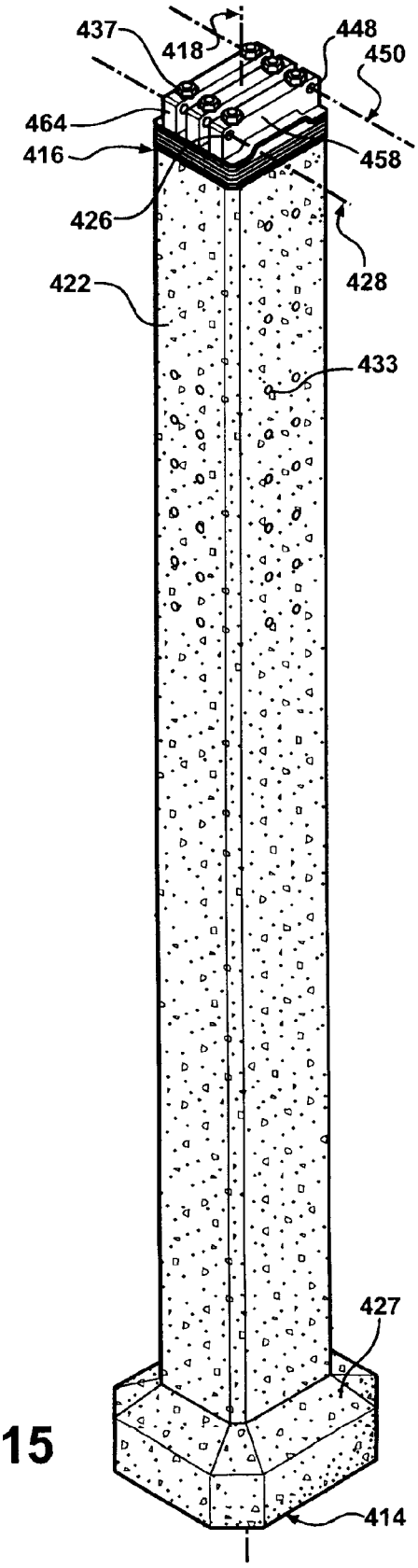
FIG - 15

METHOD OF ERECTING A WALL HAVING A VERTICALLY ADJUSTABLE HINGED SUPPORT COLUMN

CROSS-REFERENCES TO RELATED APPLICATIONS

This Application is a divisional patent application of U.S. Ser. No. 10/917,901 filed on Aug. 13, 2004 now U.S. Pat. No. 7,343,713 which is a continuation-in-part of U.S. patent application Ser. No. 10/794,905 filed on Mar. 5, 2004 now U.S. Pat. No. 7,275,351 which claims the benefit of U.S. Provisional Patent Application No. 60/526,839 filed on Dec. 4, 2003, U.S. Provisional Patent Application No. 60/494,690 filed on Aug. 12, 2003, and U.S. Provisional Patent Application No. 60/452,897 filed on Mar. 7, 2003.

FIELD OF THE INVENTION

The subject invention relates to a piling assembly for a building. More specifically, the subject invention relates to a hinged piling assembly for a building.

BACKGROUND OF THE INVENTION

Typically, post-frame construction of buildings employs setting a series of pilings, usually made of wood, into the earth to define the perimeter of the building. Once the perimeter is set with the pilings, the building is framed in an upright position by connecting wall girts to the adjacent pilings. A disadvantage of using wood piling is that they can break down in the earth over time and, in the case of chemically treated wood, the pilings can release chemicals into the ground. To overcome this particular problem, it is known in the art to use a two-piece piling assembly having an upper and a lower piling where the lower piling is reinforced concrete. Once the lower piling is set into the ground, the upper piling is attached to the upper piling and framing of the building commences.

To facilitate this type of construction, the upper and lower pilings can be connected at a hinge. The building walls are framed on the ground using the upper pilings. Following construction of the frame, each wall is rotated upward about the hinged connection and pinned for retention.

An example of this type of construction can be seen in U.S. Pat. No. 4,662,146 to Parry (the '146 patent). A lower hinge plate is connected to the top of the lower piling by fasteners. The hinge plate is a generally flat plate having a pair of opposing walls that extend vertically from edges of the hinge plate. A pair of opposing grooves are defined in front edges of the opposing walls, at the plate. Similarly, a pair of opposing holes are defined near the rear edges of the opposing walls. A shoe is attached to a lower end of the upper piling by fasteners. The shoe has a flat bottom and three walls that extend vertically from edges of the bottom. Two of the walls are opposing with the third wall extending between the rear edges. A pair of opposing pins extend from the lower front edge of the opposing walls, at the bottom. Similarly, a pair of opposing holes are defined in the opposing walls near the rear of the walls, spaced from the bottom.

The lower end of the lower piling is set in the ground, leaving the upper end of the piling exposed. On the ground, frames, made up of columns with rafters or beams, are connected together at a gable. The shoes are attached to the lower ends of the columns. Each frame is positioned such that the pins of the shoe are slid into the corresponding grooves on the lower hinge plate. Using a cable assembly, the frame is pulled into an upright position, rotating about the pins. This brings the holes on the shoe into alignment with the holes on the lower hinge plate. The frame is retained in an upright position by inserting pins through the holes.

This type of construction increases the amount of work that can be performed at ground level and could conceivably allow a single individual to hoist the frame into an upright position. However, it would still require more than one person to align the pins of the frame to the hinge plates of the lower pilings that are pre-set into the ground. The present invention is aimed at one or more of the problems identified above.

BRIEF SUMMARY OF THE INVENTION

The invention provides a jack piling assembly for a building with a piling having a longitudinal axis and a passage extending between a top and a bottom, a bearing plate at the bottom, and a jack mechanism extending upwardly from the bearing plate. The jack mechanism includes an adjustment device at the top and connected to the jack mechanism for raising the piling relative to the bearing plate.

A method of erecting a wall for a building using a jack piling having a top and a bottom and a second piling having a top and a bottom, said method comprising the steps of excavating a first hole and a second hole in the surface of the earth to a floor in each hole, placing the bottom of the jack piling having a hinge axis at the top onto the floor in the first hole, placing the bottom of the second piling having a hinge axis at the top onto the floor in the second hole, and adjusting the position of the bottom of the jack piling upwardly and away from the floor of the first hole to bring the hinge axis of the jack piling upwardly and into alignment with the hinge axis of the second piling.

BRIEF DESCRIPTION OF THE SEVERAL VIEWS OF THE DRAWINGS

Other advantages of the present invention will be readily appreciated as the same becomes better understood by reference to the following detailed description when considered in connection with the accompanying drawings wherein:

FIG. 12 is a perspective view of a reinforcing cage for a fourth alternative of a lower piling;

FIG. 13 is a perspective view of a lower piling for a fourth alternative of a lower piling with the reinforcing cage encased in concrete;

FIG. 14 is a exploded view of the adjustable hinge of a lower reinforcing cage encased in concrete for a fourth alternative of a lower piling;

FIG. 15 is a perspective view of an assembled adjustable hinge for a fourth alternative of a lower piling;

DETAILED DESCRIPTION OF THE INVENTION

Figure 1A:
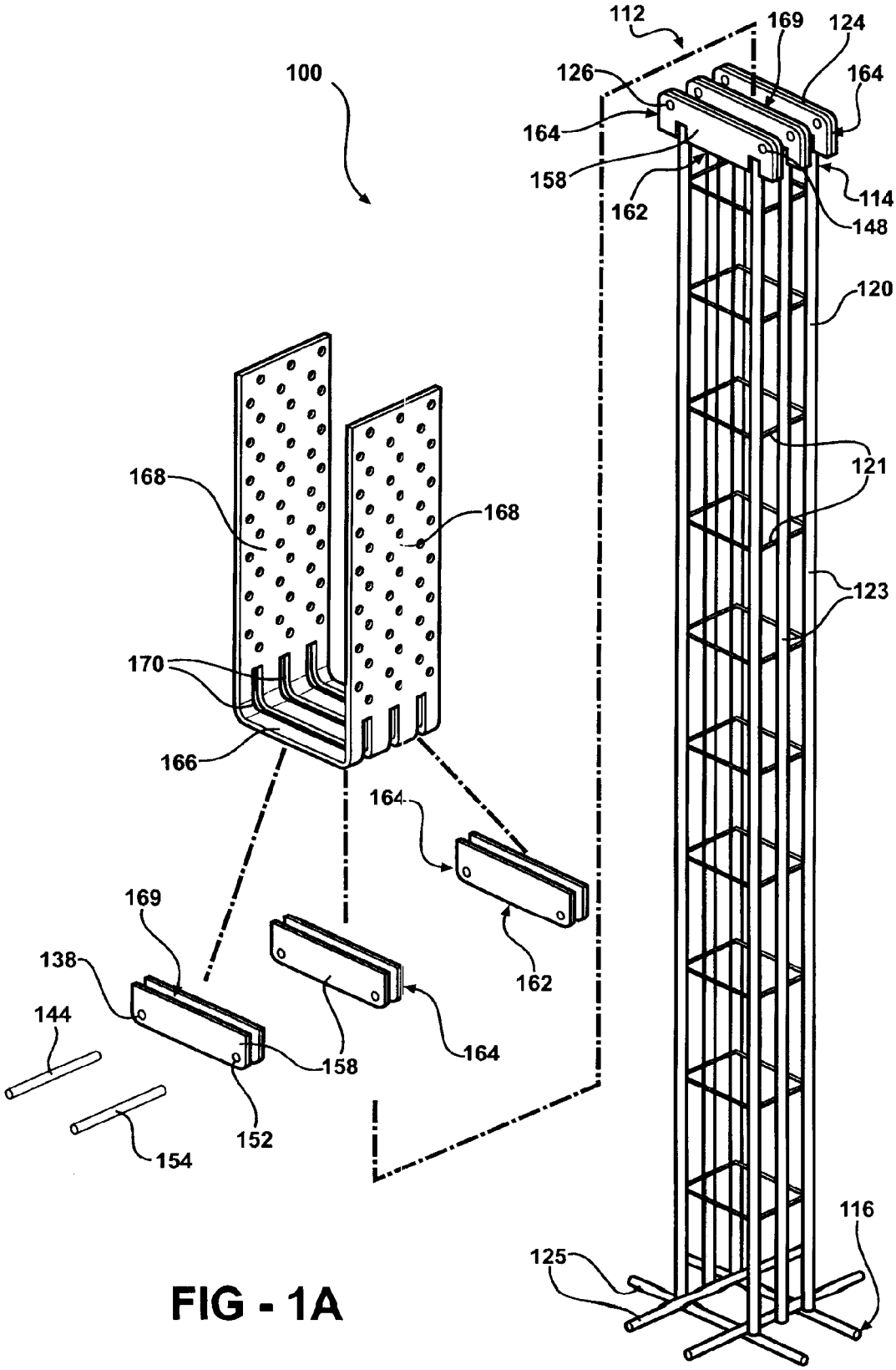
FIG. 1A is an exploded perspective view of a piling assembly according to an embodiment of the present invention.

Referring to the Figures, wherein like numerals indicate like parts throughout the several views, a piling assembly for a building is shown generally at 100. The piling assembly 100 comprises a lower piling 112 hingedly connected to an upper piling 130. The lower piling has a first and a second end 114, 116 with a first longitudinal axis 118 extending therethrough. The upper piling 130 has a column 132 with a second longitudinal axis 134 extending therethrough.

Figure 1B:
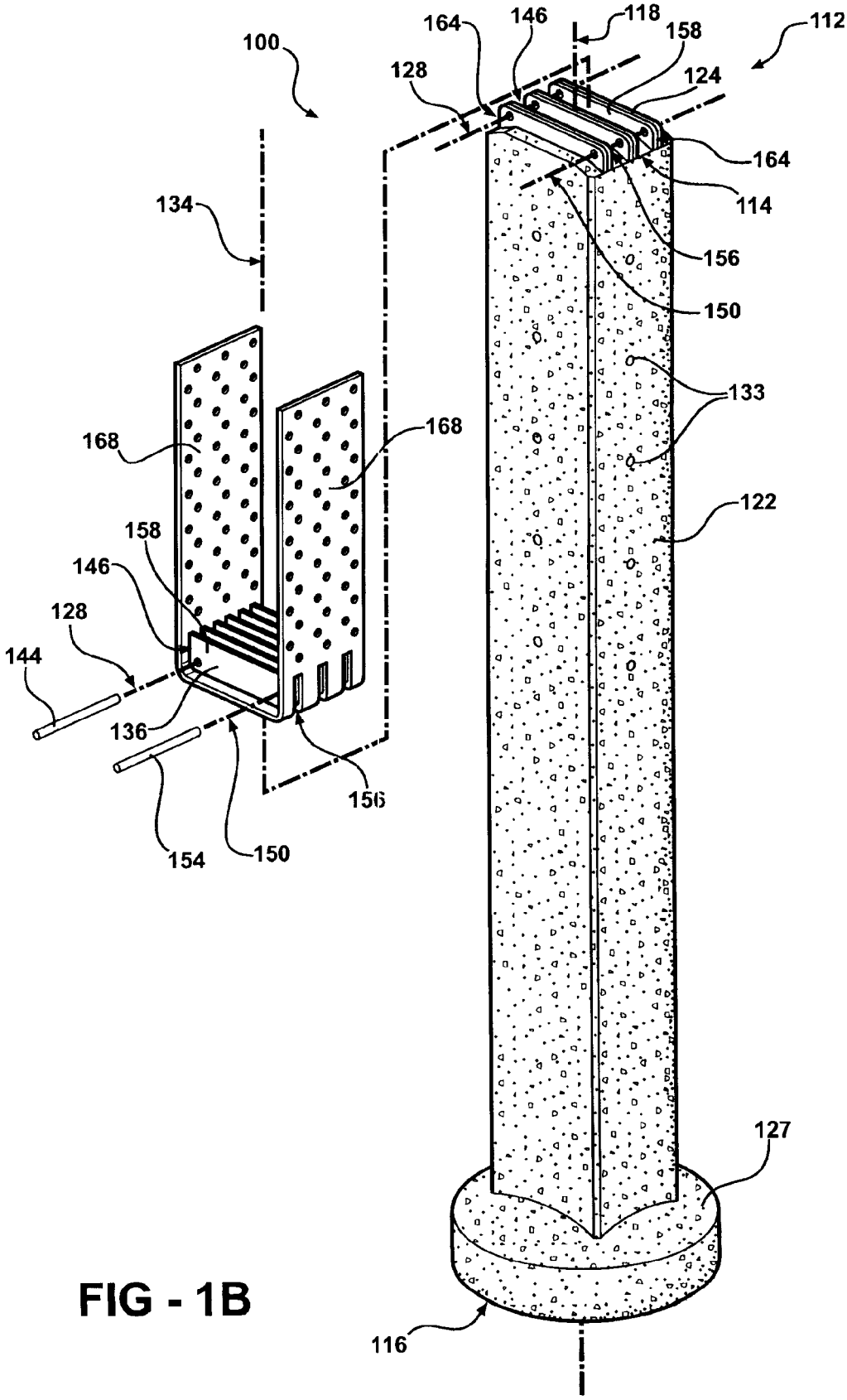
FIG. 1B is an perspective view of an unassembled piling assembly with the reinforcing cage encased in concrete.

A reinforcing cage 120 extends between the ends 114, 116 and concrete 122 encases the cage 120. Many types of reinforcing cages 120 are known in the area of pilings. One type of reinforcing cage 120 is shown in FIG. 1A. Here, a plurality of vertically extending reinforcing rods 123 defines the perimeter of the reinforcing cage 120. A plurality of reinforcing hoops 121, i.e., cross-members, formed from wire or rods, are rigidly connected to the vertically extending reinforcing rods 123 at the inside of the perimeter of the reinforcing cage 120 to provide additional reinforcement. The rods 123 are rigidly connected to a plurality of horizontally placed rods 125 to form a footing 127. In one aspect of the present invention, shown in FIG. 1B, the lower piling 112 is pre-cast off-site and transported to the job site. A plurality of thru-holes 133 can be pre-cast into the concrete 122 to attach various framing pieces F, concrete anchors, etc. to the lower piling 112. Typically, a hole is dug into the earth for receiving a portion of the lower piling 112. Following excavation of the hole, the second end 116, and a portion of the lower piling 112, is buried below ground. Finally, the hole is back filled with dirt, concrete or any other suitable material.

To provide an attachment scheme for the upper piling 130, a lower hinge 124 extends from the first end 114 and defines at least one lower first hole 126 on a first axis 128 that is spaced from the first end 114. The upper piling 130 has a column 132 and a second longitudinal axis 134 extending therethrough. Typically, the column 132 is comprised of wood, steel, aluminum or a composite. The upper hinge 136 extends from the column 132 and defines at least one upper first hole 138 on the first axis 128. The lower hinge 124 also defines a lower second hole 148, on a second axis 150 which is spaced transversely across the lower piling 112 from the lower first hole 126 and spaced from the first end 114. The upper hinge 136 also defines an upper second hole 152, on the second axis 150, which is spaced transversely across the upper piling 130 from the upper first hole 138.

Figure 2:
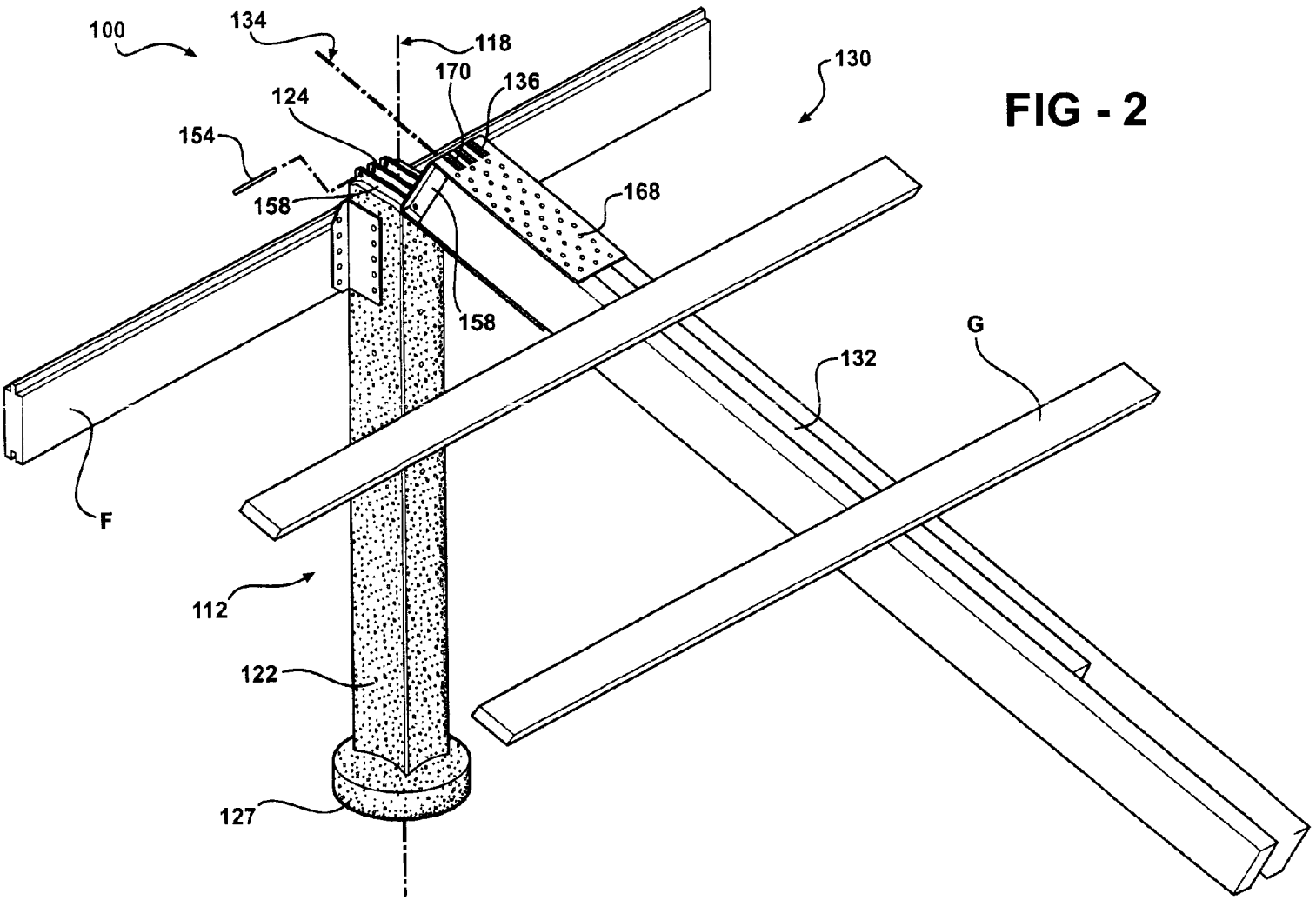
FIG. 2 is perspective view of the assembled piling assembly with various framing pieces attached to the upper and lower pilings and with the upper piling in a downward tilted position.
Figure 3:
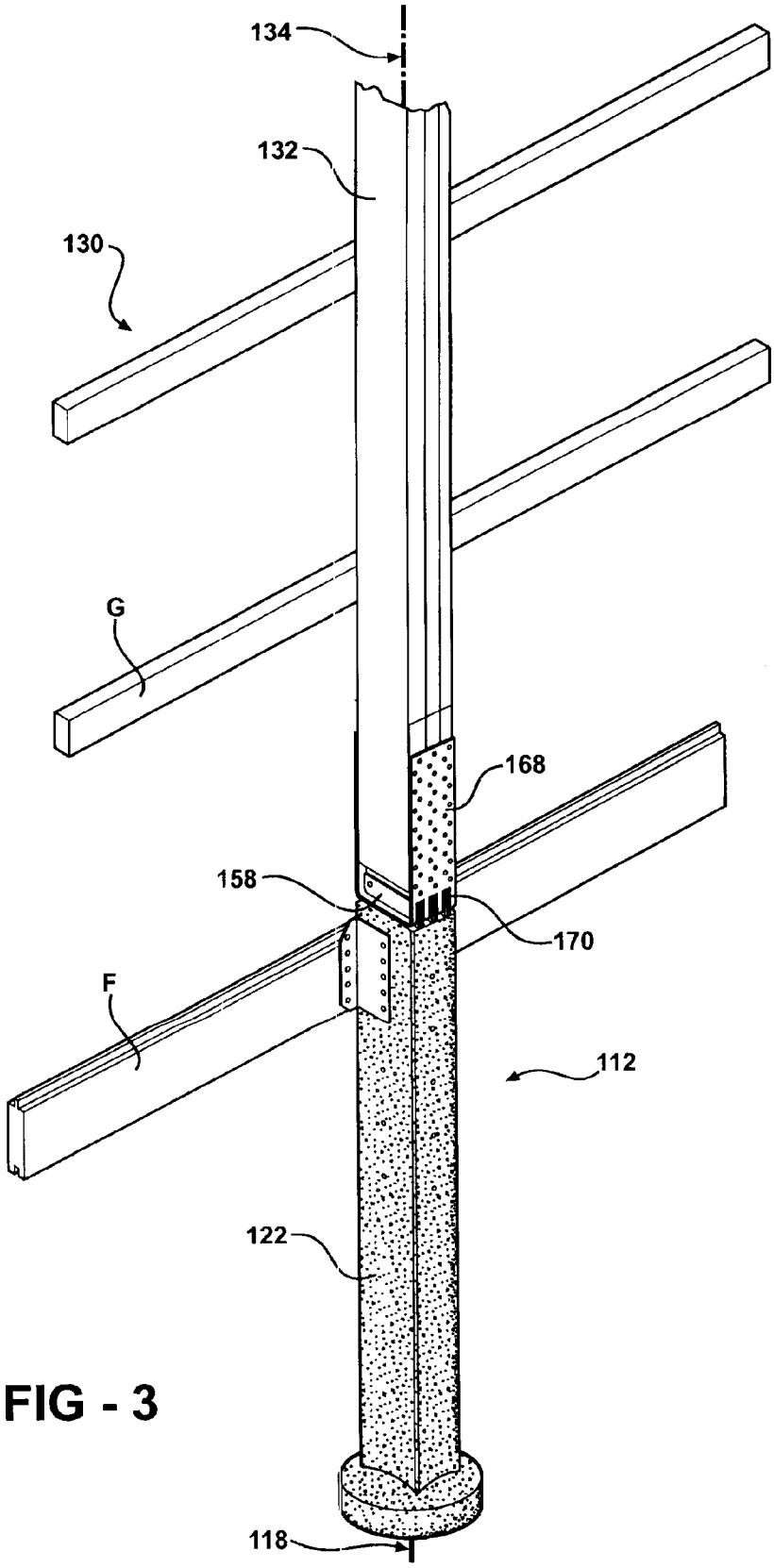
FIG. 3 is a perspective view of the assembled piling assembly with various framing pieces attached to the upper and lower pilings and with the upper piling in an upright and locked position.

In the early stages of building construction, the upper and lower hinges 136, 124 are partially interleaved, as shown in FIG. 2, such that only a first pin 144 connects the upper hinge 136 to the lower hinge 124, along the first axis 128, and the second longitudinal axis 134, for the upper piling 130, is at an angle to the first longitudinal axis 118, for the lower piling 112. As a result, the columns 132 for the building can set tilted onto the ground. This position allows wall girts G to be connected to the columns 132 to facilitate the framing of an entire wall, or at least a portion of a wall, at ground level. Once the framing with the wall girts G is completed, the upper pilings 130 that form an entire wall, or a portion of a wall, are hoisted upward as a single unit, pivoting about the first pin 144 on the first axis 128. Then, the upper pilings 130 are hoisted upward, about the first axis 128, until the upper and lower hinges 136, 124 are completely interleaved with one another and the second axes 150, for the upper and lower second holes 152, 148, are aligned. When the hinges 136, 124 are completely interleaved, the first pin 144 is extending through the upper and lower first holes 126, 138, on the first axis 128, to engage and support the hinges 136, 124. Likewise, a second pin 154 is extending through the upper and lower second holes 152, 148, on the second axis 150, to engage and support the hinges 136, 124 when the longitudinal axes 118, 134 are aligned, as shown in FIG. 3.

Each of the upper and lower hinges 136, 124 include a first plurality of hinge knuckles 146, disposed about the first pin 144, where the knuckles 146 of the upper hinge 136 are interleaved with the knuckles 146 of the lower hinge 124. The knuckles 146 hold the first pin 144 in spaced relationship to the upper and lower pilings 130, 112 to transmit longitudinal forces between the pilings 130, 112 through the first pin 144. These forces include the loads resulting from the weight of the wall girts G, the roof, various other building materials and environmental factors. Similarly, the hinges 136, 124 include a second plurality of locking knuckles 156 that are disposed about the second pin 154 with the locking knuckles 156 of the upper hinge 136 interleaved with the locking knuckles 156 of the lower hinge 124. The locking knuckles 156 hold the second pin 154 in spaced relationship to the pilings 130, 112 to transmit longitudinal forces between the pilings 130, 112 totally through the first and second pins 144, 154. Therefore, the pins 144, 154 support the entire load provided by the upper pilings 130, wall girts G, the roof, various other building materials and environmental factors.

Each of the hinges 136, 124 includes a plurality of plates 158 that are in spaced and parallel relationship. A gap 169 is defined between each of the plates 158 to facilitate the upper hinge 136 interleaving with the lower hinge 124. The first hole 126 or 138 is defined through each of the plates 158, along the first axis 128. The second hole 148 or 152 is also defined through each of the plates 158, along the second axis 150, and spaced transversely across each of the plates 158 from the first hole 126 or 138 respectively. Furthermore, the plates 158 define a bottom edge 162 and end edges 164.

The lower hinge 124 is attached to the lower piling 112 at the bottom edge 162 and the holes 126, 148 are in spaced relationship from the lower piling 112. The upper hinge 136 includes a bottom 166 and a pair of opposing walls 168 that extend upward from the bottom 166, along the column 132. The bottom edge 162 of each of the plates 158 are attached to the bottom 166 of the upper hinge 136 and the end edges 164 of each of the plates 158 are attached to the opposing walls 168. Furthermore, the bottom 166 and the opposing walls 168 define a plurality of grooves 170 that extend in spaced and parallel relationship across the bottom 166 and into a portion of the walls 168, between each of the plates 158. The grooves 170 allow the hinge plates 158 of the lower hinge 124 to interleave with the plates 158 of the upper hinge 136.

Another embodiment of the piling assembly 200, shown in FIGS. 4A-E, comprises a lower piling 212 hingedly connected to an upper piling 230. The lower piling 212 has a first and a second end 214, 216 and a first longitudinal axis 218 extending therethrough. The upper piling 230 has a column 232 and a second longitudinal axis 234 extending therethrough.

Figure 4A:
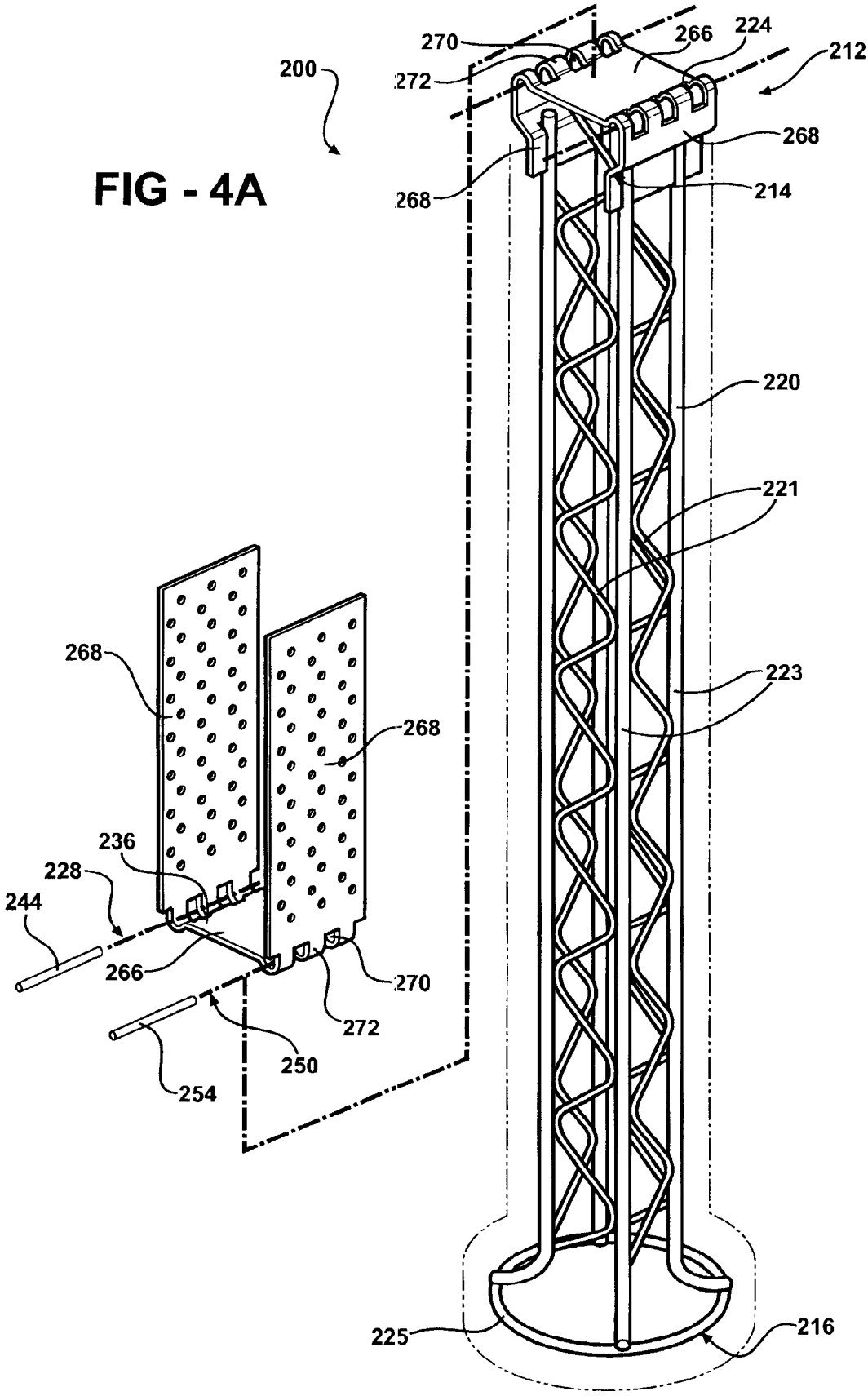
FIG. 4A is a perspective view of a second alternative piling assembly.
Figure 4B:
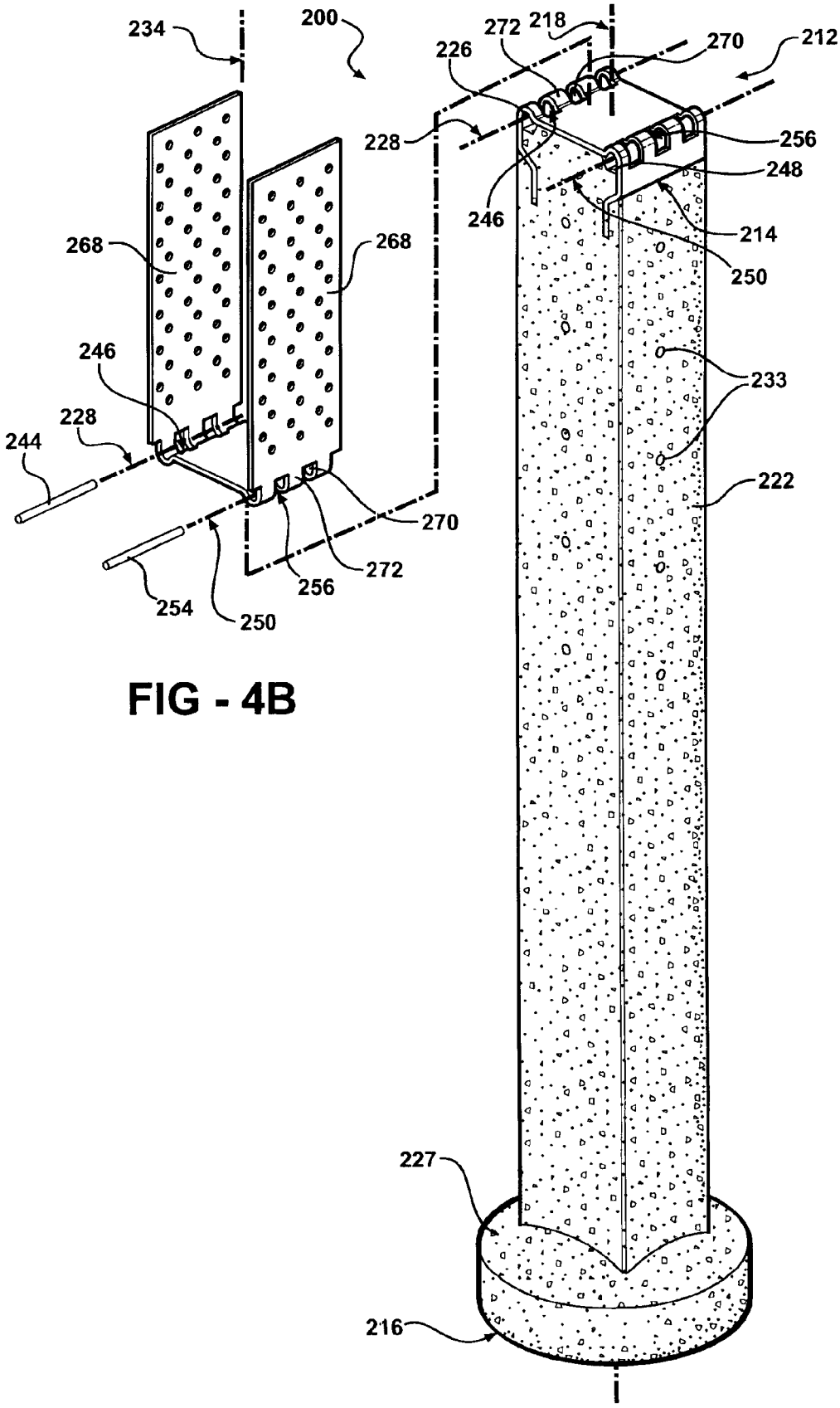
FIG. 4B is a perspective view of a second alternative piling assembly with the reinforcing cage encased in concrete.

A reinforcing cage 220, as shown in FIG. 4A, extends between the ends 214, 216 and concrete 222 encases the cage 220. This embodiment of the lower piling 212 discloses another type of reinforcing cage that can be pre-cast off-site. The reinforcing cage 220 has four vertically extending rods 223 that define an outer perimeter of the reinforcing cage 220. The rods 223 curve outward at the second end 216 and are attached to a hooped rod 225 to define a footing 227. Corrugated support rods 221 are disposed between each pair of adjacent vertical rods 223 along the outer perimeter of the reinforcing cage 220, to provide additional reinforcement to the reinforcing cage 220. A plurality of thru-holes 233, for attaching various framing pieces F to the lower piling 212, can also be pre-cast into the lower piling 212, as shown in FIG. 4B.

To provide an attaching scheme, a lower hinge 224 extends from the first end 214 and defines at least one lower first hole 226 on a first axis 228 that is spaced from the first end 214. Similarly, the upper piling 230 has an upper hinge 236 that extends from the column 232 and defines at least one upper first hole 238 on the first axis 228. The lower hinge 224 also defines a lower second hole 248, on a second axis 250, and is spaced transversely across the lower piling 212 from the lower first hole 226 and spaced from the first end 214. Likewise, the upper hinge 236 defines an upper second hole 252, on the second axis 250, and is spaced transversely across the upper piling 230 from the upper first hole 238.

Figure 4C:
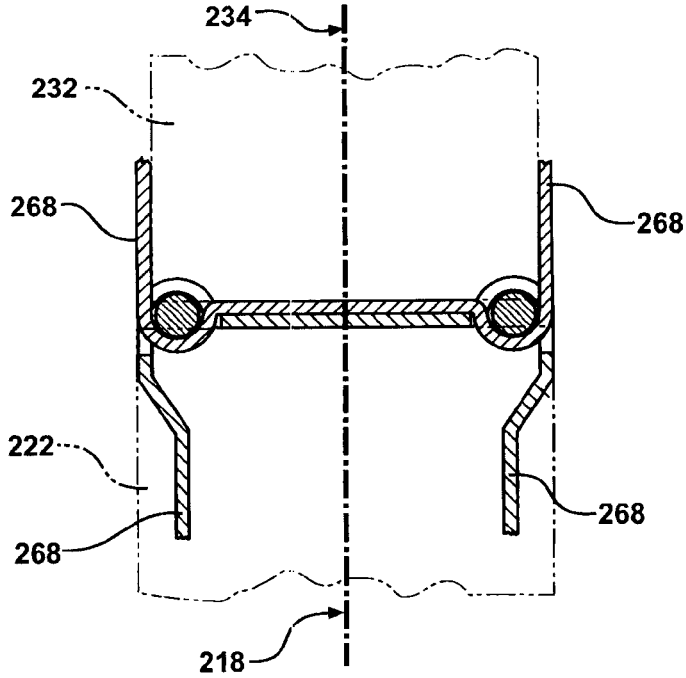
FIG. 4C is a sectional side view of the hinged and pinned connection between the upper and lower hinges for a second alternative piling assembly.
Figure 4D:
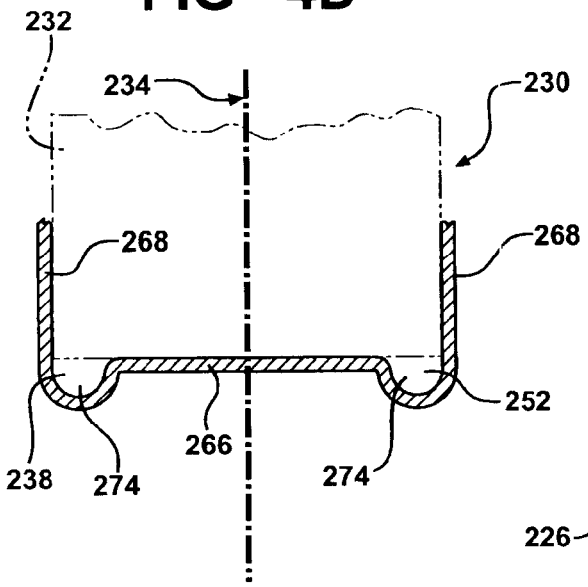
FIG. 4D is a sectional side view of the upper piling for a second alternative piling assembly.
Figure 4E:
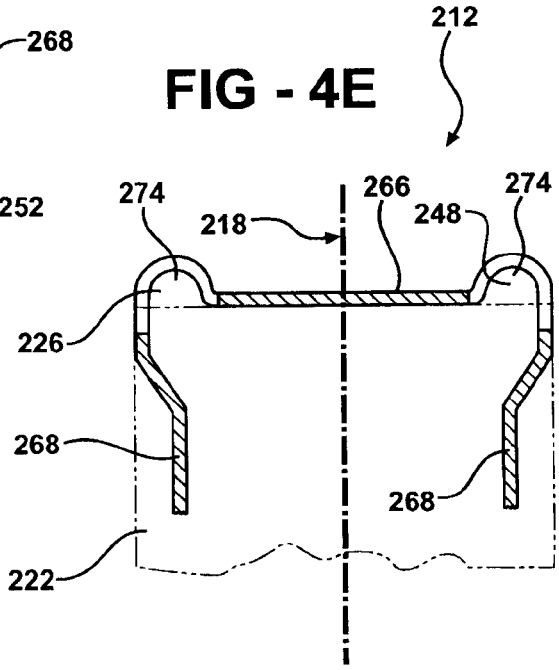
FIG. 4E is a sectional side view of the lower piling for a second alternative piling assembly.
Figure 5:
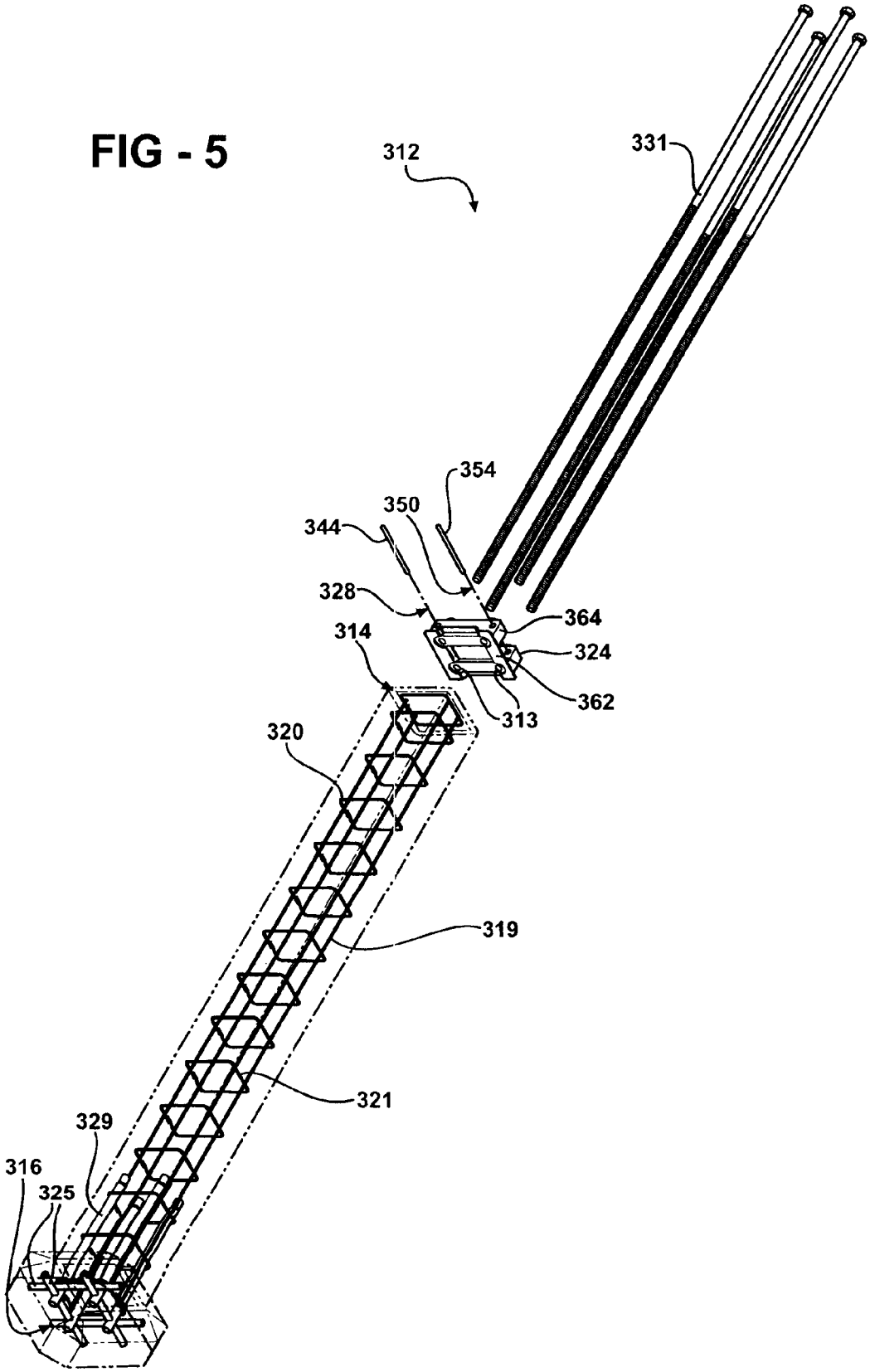
FIG. 5 is an exploded perspective view of a reinforcing cage for a third alternative of a lower piling.

In the early stages of building construction, the upper and lower hinges 236, 224 are partially interleaved such that only a first pin 244 connects the upper hinge 236 to the lower hinge 224, along the first axis 228, and the second longitudinal axis 234, for the upper piling 230, is at an angle to the first longitudinal axis 218, for the lower piling 212. As a result, the columns 232 for the building can set tilted onto the ground. This position allows wall girts G to be connected to the columns 232 to facilitate the framing of an entire wall, or a partial wall, at ground level. Once the framing with the wall girts G is completed, the upper pilings 230 that form an entire wall, or a partial wall, are hoisted upward as a single unit, pivoting about the first pin 244 on the first axis 228. Then, the upper pilings 230 are hoisted upward, about the first axis 228, until the upper and lower hinges 236, 224 are completely interleaved with one another and the second axes 250, for the upper and lower second holes 252, 248 are aligned. When the hinges 236, 224 are completely interleaved, the first pin 244 extends through the upper and lower first holes 236, 226 on the first axis 228 to engage and support the hinges 236, 224. Likewise, a second pin 254 extends through the upper and lower second holes 252, 248 on the second axis 250 to engage and support the hinges 236, 224 when the longitudinal axes 218, 234 are aligned, as shown in FIG. 4C.

The hinges 236, 224 include a first plurality of hinge knuckles 246 that are disposed about the first pin 244, where the knuckles 246 of the upper hinge 236 are interleaved with the knuckles 246 of the lower hinge 224. The knuckles 246 hold the first pin 244 in spaced relationship to the pilings 212, 230 to transmit longitudinal forces between the pilings 212, 230 through the first pin 244. These forces include those resulting from the wall girts G, the roof of the building structure, and various other building materials and environmental factors. The hinges 236, 224 also include a second plurality of locking knuckles 256 that are disposed about the second pin 254 with the locking knuckles 256 of the upper hinge 236 interleaved with the locking knuckles 256 of the lower hinge 224. The locking knuckles 256 hold the second pin 254 in spaced relationship to the pilings 230, 212 for transmitting forces between the pilings 230, 212 through the first and second pins 244, 254.

Each of the knuckles 246, 256 on each of the hinges 236, 224 comprise a plurality of straps 272 that define a pin pocket 274 for encompassing at least a portion of the circumference of one of the pins 244, 254 extending therethrough. The pin pocket 274 defines the first hole 238, 226 in one of the knuckles 246 along the first axis 228. The pin pocket also defines the second hole 252, 248 in another one of the locking knuckles 256 along the second axis 250 which is spaced transversely across one of the hinges 236, 224 from the first hole 238, 226. Grooves 270 are defined between each of the straps 272 of one hinge 236, 224 for interleaving of the upper and lower hinges 236, 224.

Additionally, the upper hinge 236 includes a bottom 266 and a pair of opposing walls 268 that extend from the bottom 266 and across the upper pilings 230. The first and locking knuckles 246, 256 are disposed between the walls 268 and the bottom 266. In the upper piling 230, the knuckles 246, 256 are disposed in spaced relationship on the upper hinges 236 across the upper piling 230 and are also in spaced relationship to the column 232. Similarly, the lower hinge 224 is attached to the lower piling 212 at the walls 268. The lower holes 226, 248 are in spaced relationship to the first end 214 of the lower piling 212.

In yet another embodiment, as shown in FIGS. 5-11, the piling assembly 300 comprises a height-adjustable lower piling 312 hingedly connected to an upper piling 330. The lower piling has a first and a second end 314, 316 with a first longitudinal axis 318 extending therethrough. The upper piling 330 has a column 332 with a second longitudinal axis 334 extending therethrough.

Figure 6:
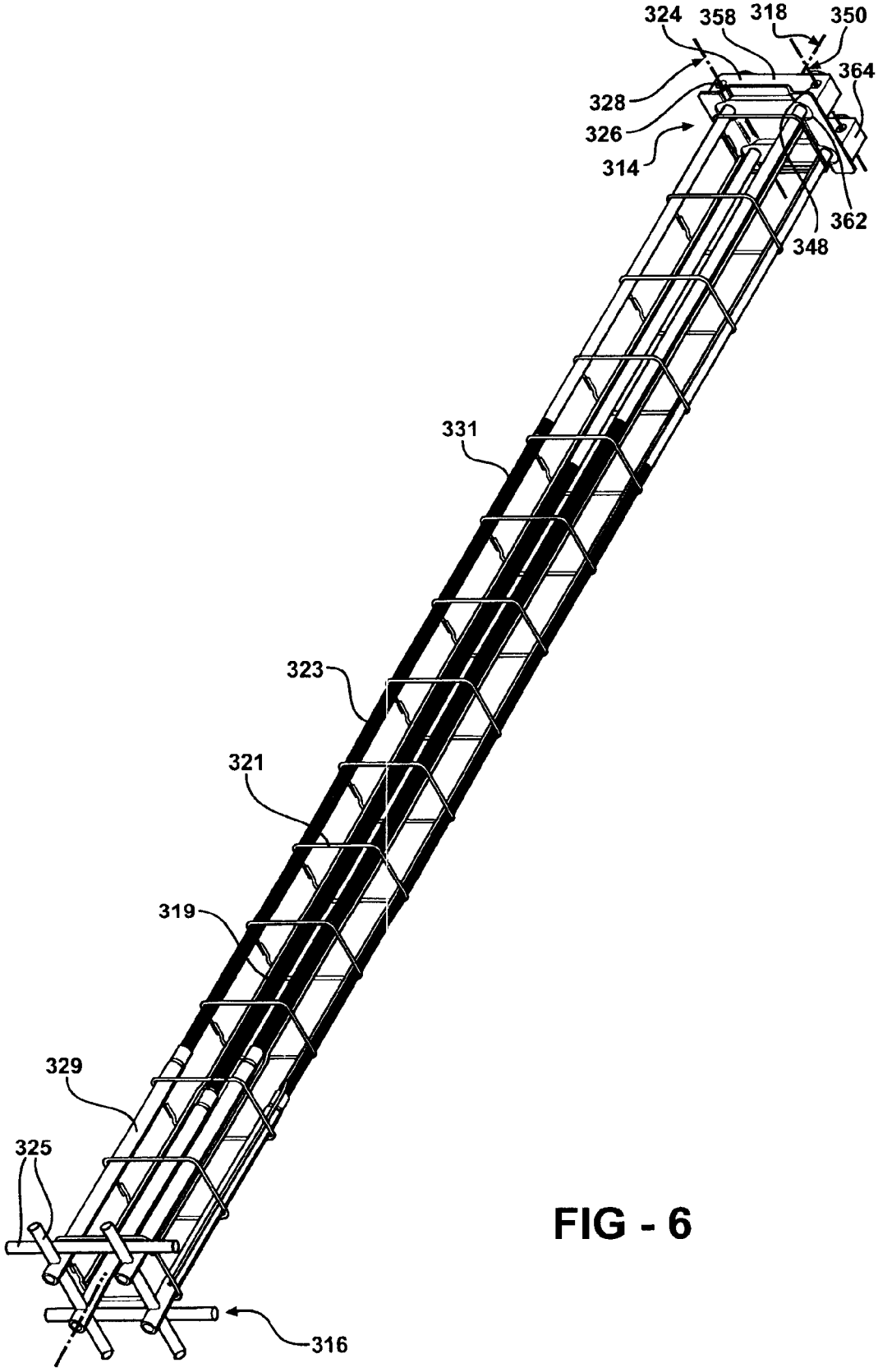
FIG. 6 is a perspective view of a reinforcing cage for a third alternative of a lower piling.
Figure 7:
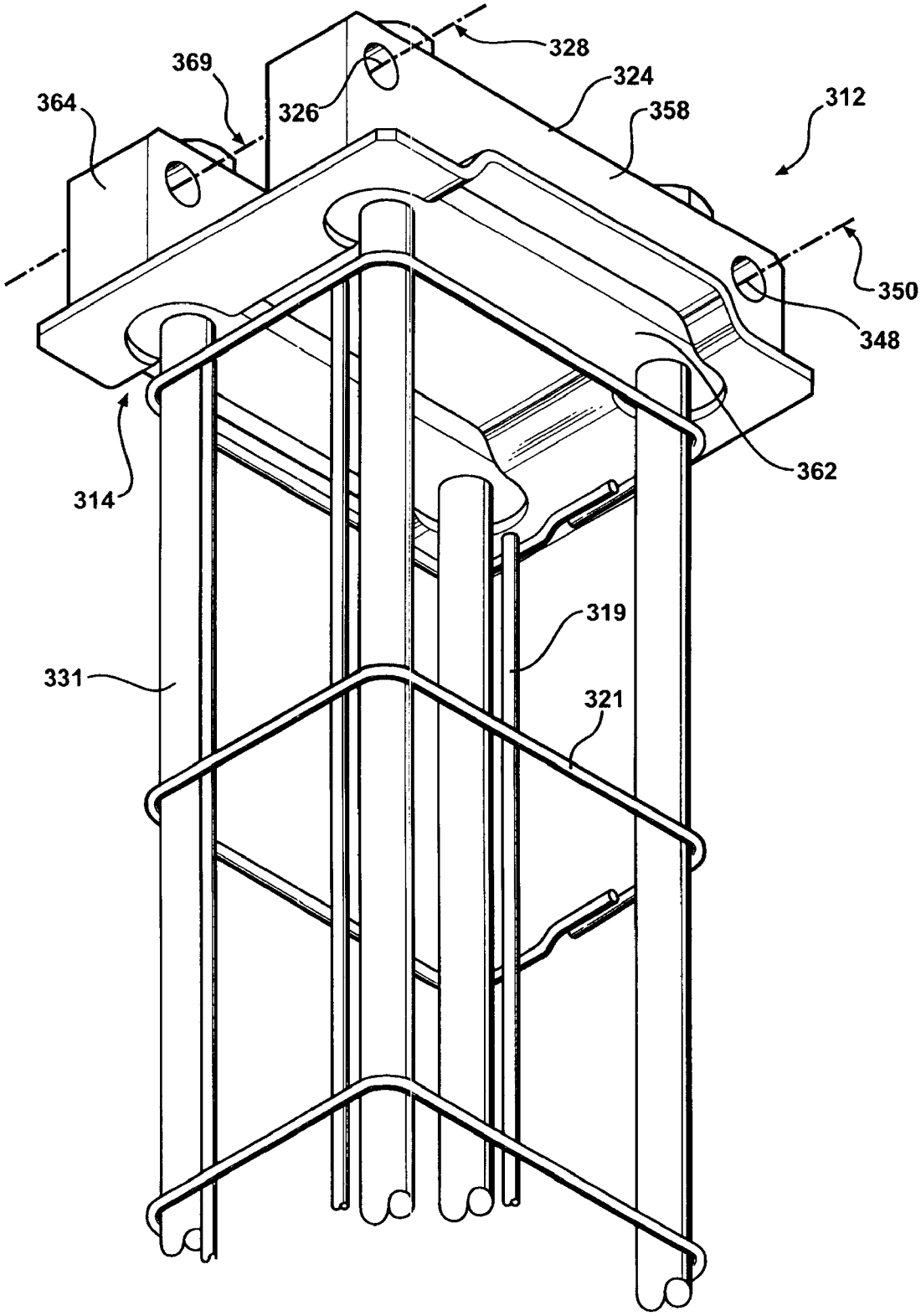
FIG. 7 is a perspective view of a first end of a reinforcing cage for a third alternative of a lower piling.
Figure 8:
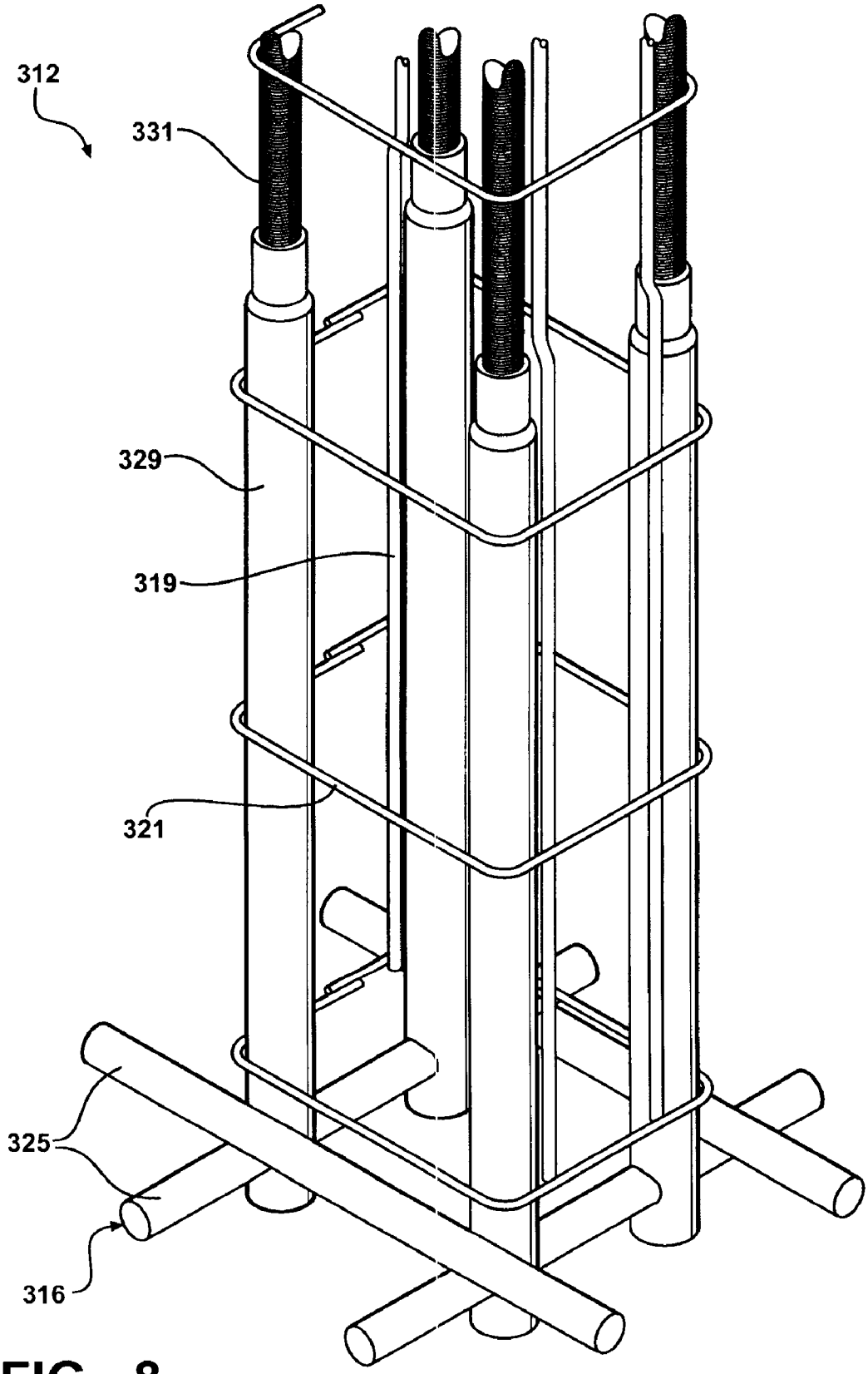
FIG. 8 is a perspective view of a second end of a reinforcing cage for a third alternative of a lower piling.
Figure 9:
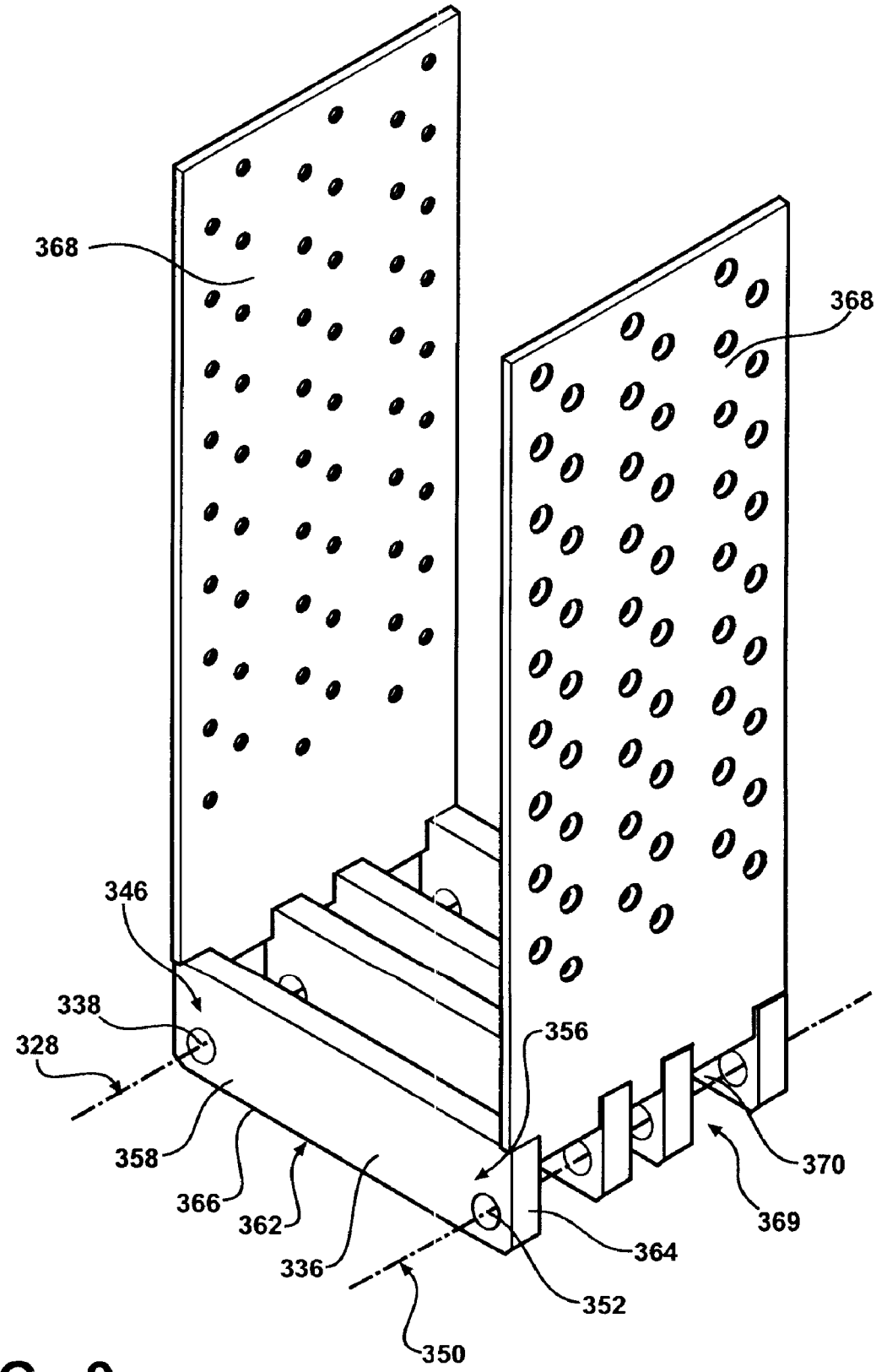
FIG. 9 is a perspective view of a hinge for a third alternative of an upper piling.

Another type of reinforcing cage 320 is shown in FIG. 6. Here, the reinforcing cage 320 is pre-cast in concrete 322. Within the reinforcing cage 320 are a plurality of two-piece vertical reinforcing rods 323, attached to a plurality of horizontally placed rods 325 that form a footing (not shown). Each of the two-piece vertical reinforcing rods 323 are comprised of a lower vertical reinforcing tube 329, which is internally threaded and integral to the reinforcing cage 320, and an upper vertical reinforcing rod 331, which has a lower threaded end for threaded engagement of the lower tube 329. To provide additional support to the reinforcing cage 320, a plurality of vertically fixed reinforcing rods 319 and a plurality of vertically spaced hoops 321 form a square perimeter. The lower piling 312 is pre-cast about the reinforcing cage 320 with vertical holes (not shown) that extend from the first end 314 to the lower vertical reinforcing tube 329. On the job site, a portion of the lower piling 312 can be cut off to a preferred height. This allows flexibility to level the lower pilings 312 once they are inserted into the ground, prior to connection to the upper pilings 330. After the pilings 312 are trimmed to the desired height at the job site, upper vertical reinforcing rods 331 are inserted through holes 313 in a lower hinge 324, into the vertical holes and then threaded into the lower vertical reinforcing tubes 329. Additionally, a plurality of thru-holes 333 can be pre-cast into the concrete 322 to facilitate attachment of various framing pieces F, concrete anchors, etc. to the lower piling 312. Typically, a hole is dug into the earth for receiving a portion of the lower piling 312. Following excavation of the hole, the second end 316, and a portion of the concrete 322, is buried below ground. Finally, the hole is back filled with dirt, concrete or any other suitable material.

To provide an attachment scheme for the upper piling 330, the lower hinge 324 extends from the first end 314 and defines at least one lower first hole 326 on a first axis 328 that is spaced from the first end 314. The upper piling 330 has a column 332 and a second longitudinal axis 334 extending therethrough. Typically, the column 332 is comprised of wood, steel, aluminum or a composite. The upper hinge 336 extends from the column 332 and defines at least one upper first hole 338 on the first axis 328. The lower hinge 324 also defines a lower second hole 348, on a second axis 350 which is spaced transversely across the lower piling 312 from the lower first hole 326 and spaced from the first end 314. The upper hinge 336 also defines an upper second hole 352, on the second axis 350, which is spaced transversely across the upper piling 330 from the upper first hole 338.

Figure 10:
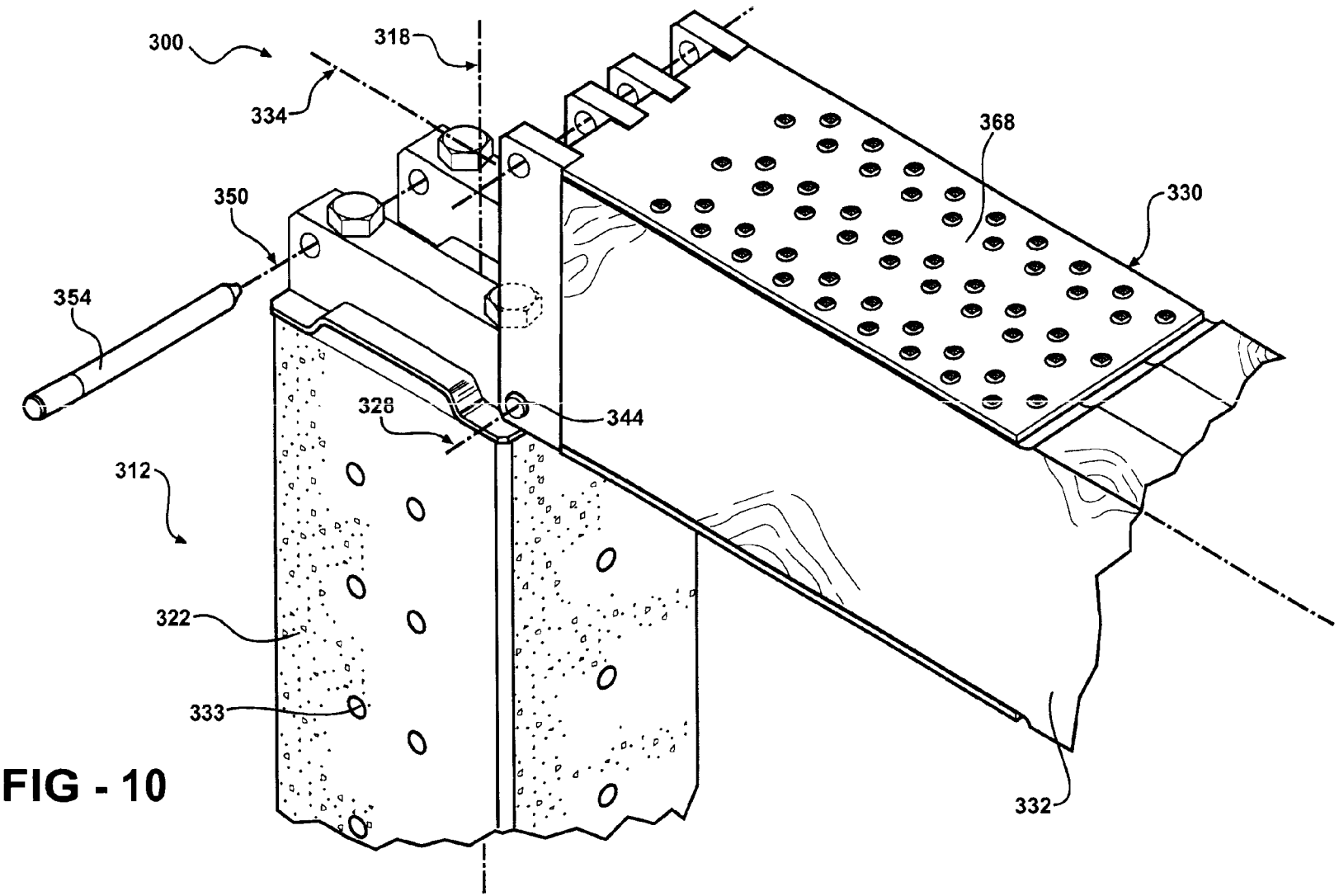
FIG. 10 is a perspective view of the hinged connection between the upper and lower piling for a third alternative of a piling assembly with the upper piling tilted away from the lower piling about a pin.
Figure 11:
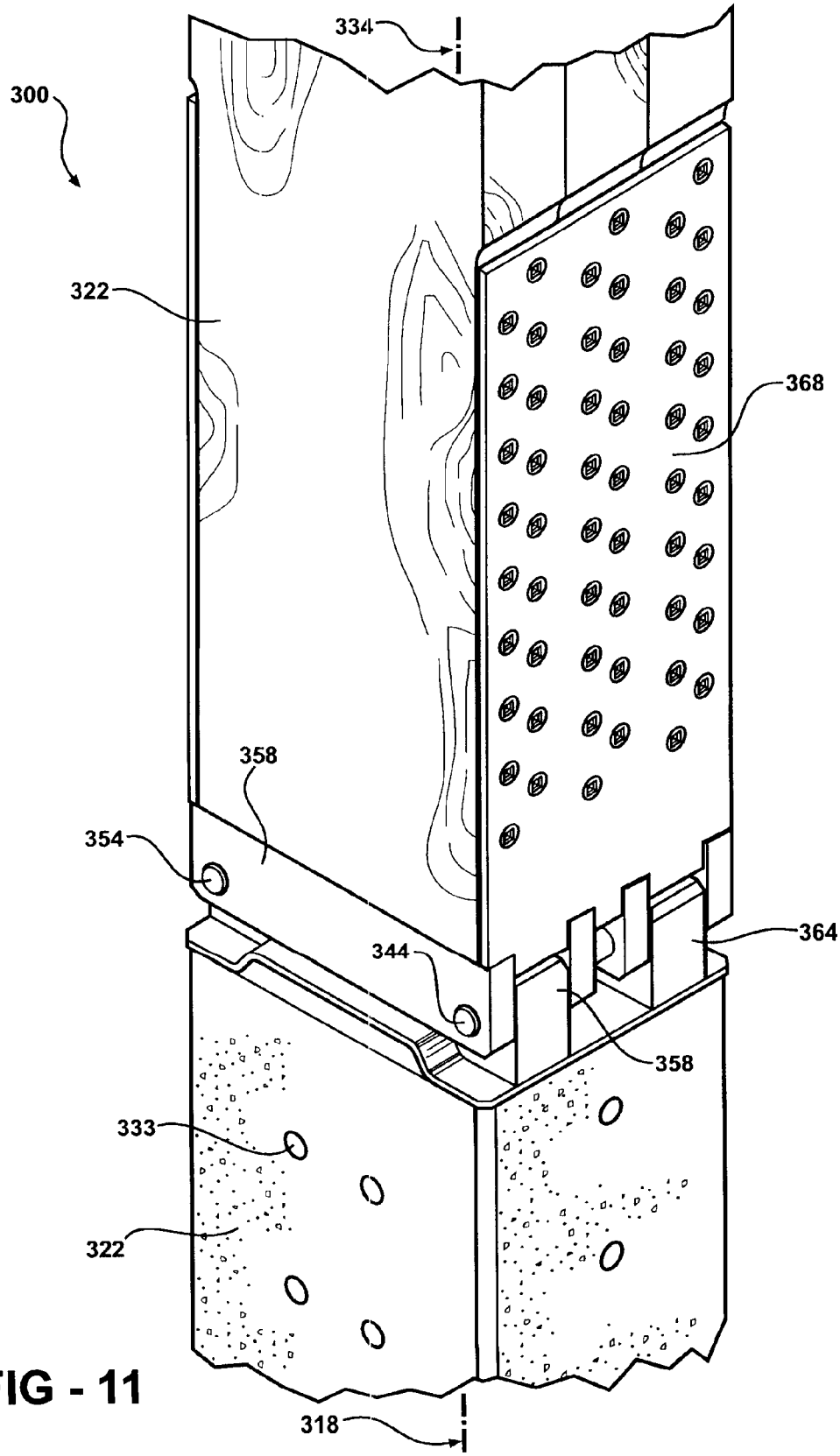
FIG. 11 is a perspective view of the hinged connection between the upper and lower piling for a third alternative of a piling assembly with the upper and lower piling in the upright and locked positions.
Figure 16:
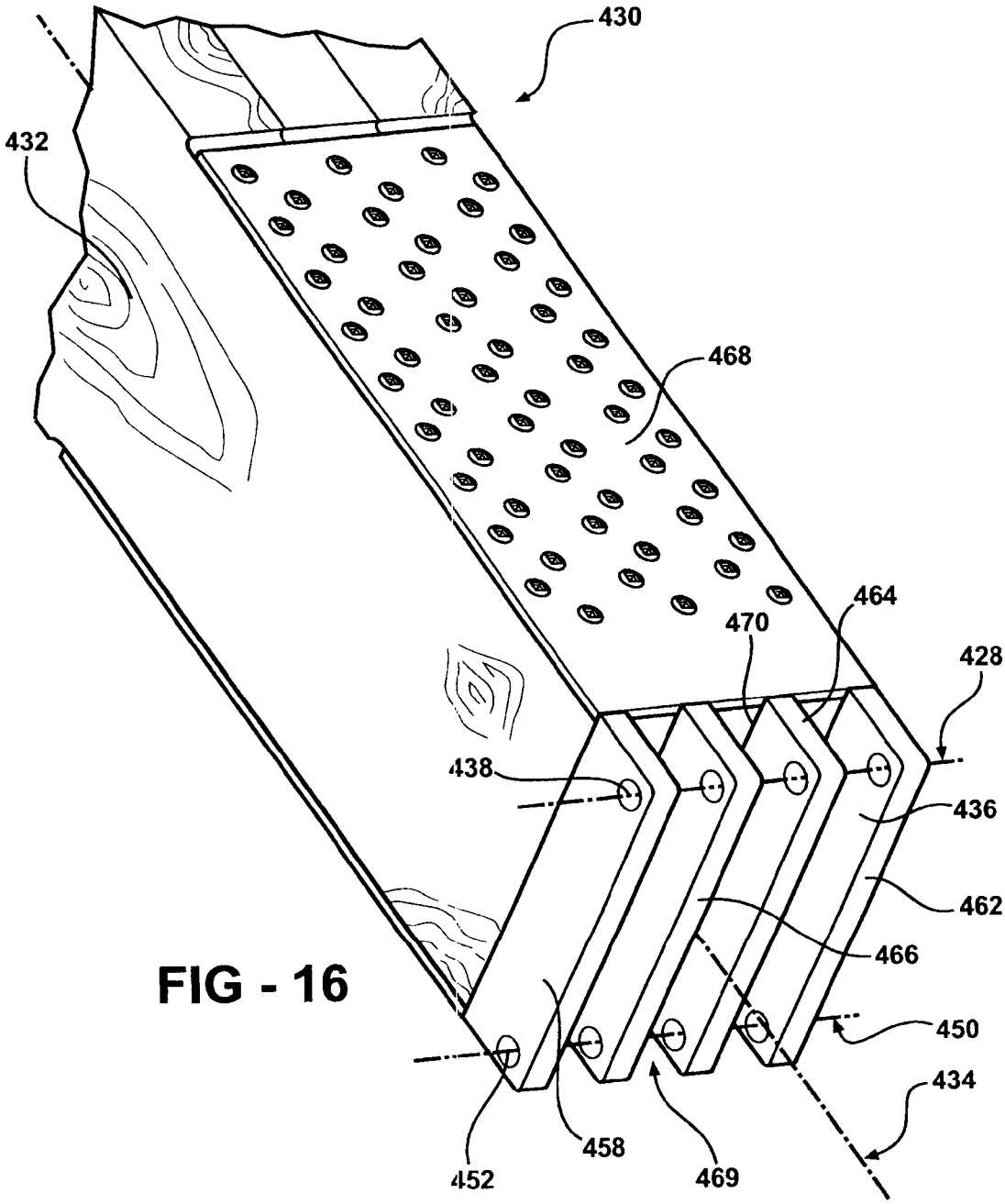
FIG. 16 is a perspective view of a hinge for a fourth alternative of an upper piling.

In the early stages of building construction, the upper and lower hinges 336, 324 are partially interleaved, as shown in FIG. 10, such that only a first pin 344 connects the upper hinge 336 to the lower hinge 324, along the first axis 328, and the second longitudinal axis 334, for the upper piling 330, is at an angle to the first longitudinal axis 318, for the lower piling 312. As a result, the columns 332 for the building can set tilted onto the ground. This position allows wall girts G to be connected to the columns 332 to facilitate the framing of an entire wall, or at least a portion of a wall, at ground level. Once the framing with the wall girts G is completed, the upper pilings 330 that form an entire wall, or a portion of a wall, are hoisted upward as a single unit, pivoting about the first pin 344 on the first axis 328. Then, the upper pilings 330 are hoisted upward, about the first axis 328, until the upper and lower hinges 336, 324 are completely interleaved with one another and the second axes 350, for the upper and lower second holes 252, 248, are aligned. When the hinges 336, 324 are completely interleaved, the first pin 344 is extending through the upper and lower first holes 326, 338, on the first axis 328, to engage and support the hinges 336, 324. Likewise, a second pin 354 is extending through the upper and lower second holes 352, 348, on the second axis 350, to engage and support the hinges 336, 324 when the longitudinal axes 318, 334 are aligned, as shown in FIG. 11.

Each of the upper and lower hinges 336, 324 include a first plurality of hinge knuckles 346, disposed about the first pin 344, where the knuckles 346 of the upper hinge 336 are interleaved with the knuckles 346 of the lower hinge 324. The knuckles 346 hold the first pin 344 in spaced relationship to the upper and lower pilings 330, 312 to transmit longitudinal forces between the pilings 330, 312 through the first pin 344. These forces include the loads resulting from the weight of the wall girts G, the roof, various other building materials and environmental factors. Similarly, the hinges 336, 324 include a second plurality of locking knuckles 356 that are disposed about the second pin 354 with the locking knuckles 356 of the upper hinge 336 interleaved with the locking knuckles 356 of the lower hinge 324. The locking knuckles 356 hold the second pin 354 in spaced relationship to the pilings 330, 312 to transmit longitudinal forces between the pilings 330, 312 totally through the first and second pins 344, 354. Therefore, the pins 344, 354 support the entire load provided by the upper pilings 330, wall girts G, the roof, various other building materials and environmental factors.

Each of the hinges 336, 324 includes a plurality of plates 358 that are in spaced and parallel relationship. A gap 369 is defined between each of the plates 358 to facilitate the upper hinge 336 interleaving with the lower hinge 324. The first hole 326 or 338 is defined through each of the plates 358, along the first axis 328. The second hole 348 or 352 is also defined through each of the plates 358, along the second axis 350, and spaced transversely across each of the plates 358 from the first hole 326 or 338 respectively. Furthermore, the plates 358 define a bottom edge 362 and end edges 364.

The lower hinge 324 is attached to the reinforcing cage 320 of the lower piling 312 along the bottom edge 362 and the lower holes 326, 348 are in spaced relationship from the lower piling 312. The upper hinge 336 includes a bottom 366 and a pair of opposing walls 368 that extend upward from the bottom 366, along the column 332. The bottom edge 362 of each of the plates 358 are attached to the bottom 366 of the lower hinge 324 and the end edges 364 of each of the plates 358 are attached to the opposing walls 368. Furthermore, the bottom 366 and the opposing walls 368 define a plurality of grooves 370 that extend in spaced and parallel relationship across the bottom 366 and into a portion of the walls 368, between each of the plates 358. The grooves 370 allow the plates 358 of the lower hinge 324 to interleave with the plates 358 of the upper hinge 336.

Another embodiment of a piling assembly 400, shown in FIGS. 12-18, comprises a height adjustable lower piling 412 hingedly connected to an upper piling 430. The lower piling 412 has a first and a second end 414, 416 with a first longitudinal axis 418 extending therethrough. The upper piling 430 has a column 432 with a second longitudinal axis 434 extending therethrough.

Another type of reinforcing cage 420 is shown in FIG. 12. Here, a plurality of vertically extending reinforcing rods 423 defines the perimeter of the reinforcing cage 420. Additionally, vertically spaced wire 221 encircles the outer perimeter of the vertically extending rods 423 to provide additional reinforcement for the reinforcing cage 420. The vertical rods 423 flare outward at the second end 416 to form a footing 427. The vertical rods extend beyond the pre-cast concrete 422 at the first end 414, terminating at threaded ends 415. The lower piling 412 is pre-cast off-site and a plurality of thru-holes 433 can be pre-cast into the concrete 422 to attach various framing pieces F, concrete anchors, etc. to the lower piling 412. Typically, a hole is dug into the earth for receiving a portion of the lower piling 412. Following excavation of the hole, the second end 416, and a portion of the lower piling 412, is buried below ground. Finally, the hole is back filled with dirt, concrete or any other suitable material. To level the first ends 414 of the lower pilings 412, once the lower pilings 412 are set in the ground, shims 435 are placed over the threaded ends 414. Once the proper height is achieved, a lower hinge 424 is also placed over the threaded ends 414 and fastened in place with nuts 437.

To provide an attachment scheme for the upper piling 430, the lower hinge 424 extends from the first end 414 and defines at least one lower first hole 426 on a first axis 428 that is spaced from the first end 414. The upper piling 430 has a column 432 and a second longitudinal axis 434 extending therethrough. Typically, the column 432 is comprised of wood, steel, aluminum or a composite. The upper hinge 436 extends from the column 432 and defines at least one upper first hole 438 on the first axis 428. The lower hinge 424 also defines a lower second hole 448, on a second axis 450 which is spaced transversely across the lower piling 412 from the lower first hole 426 and spaced from the first end 414. The upper hinge 436 also defines an upper second hole 452, on the second axis 450, which is spaced transversely across the upper piling 430 from the upper first hole 438.

Figure 17:
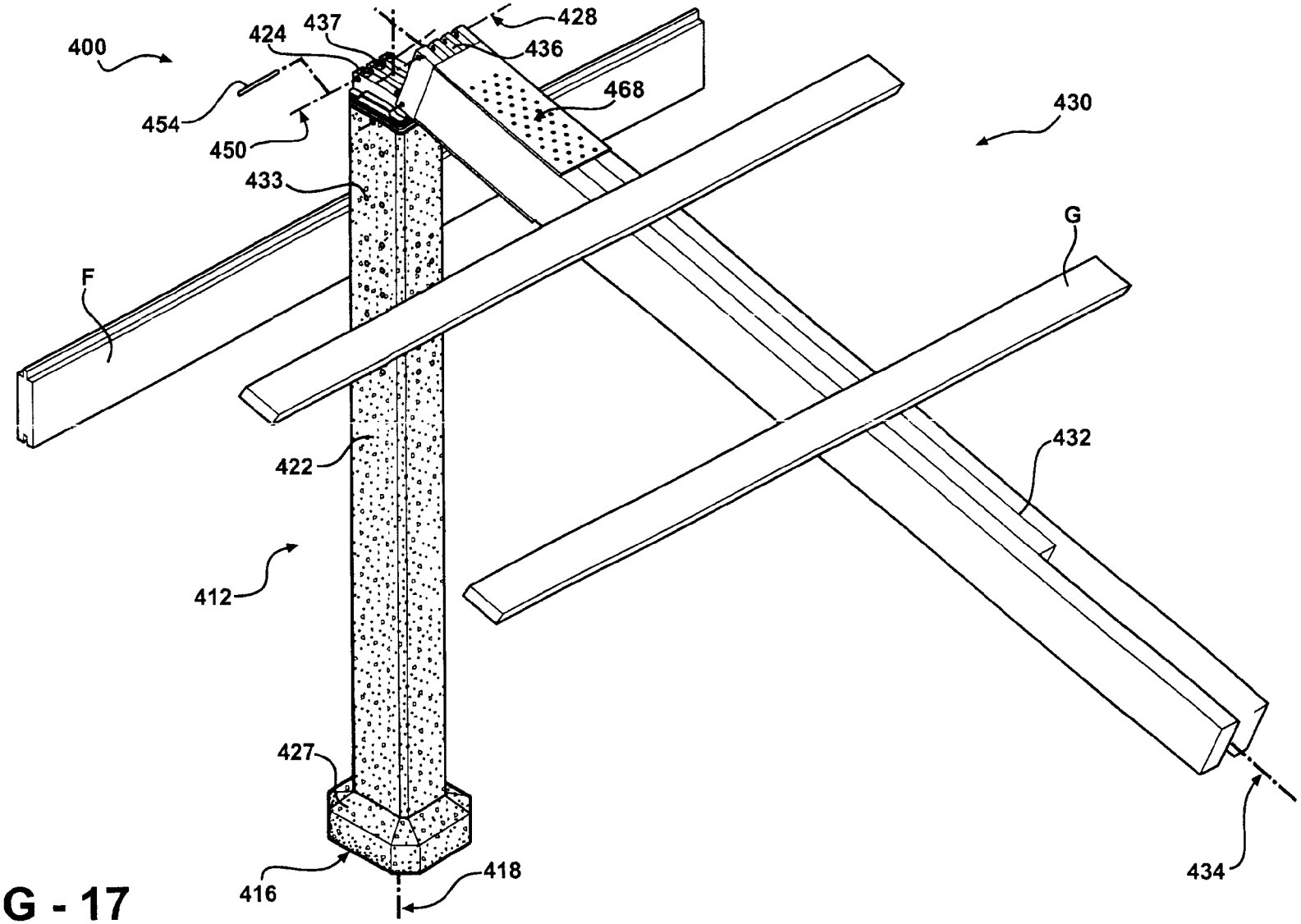
FIG. 17 is a perspective view of a hinged connection between the upper and lower piling for a fourth alternative of a piling assembly with the upper piling tilted away from the lower piling about a pin.
Figure 18:
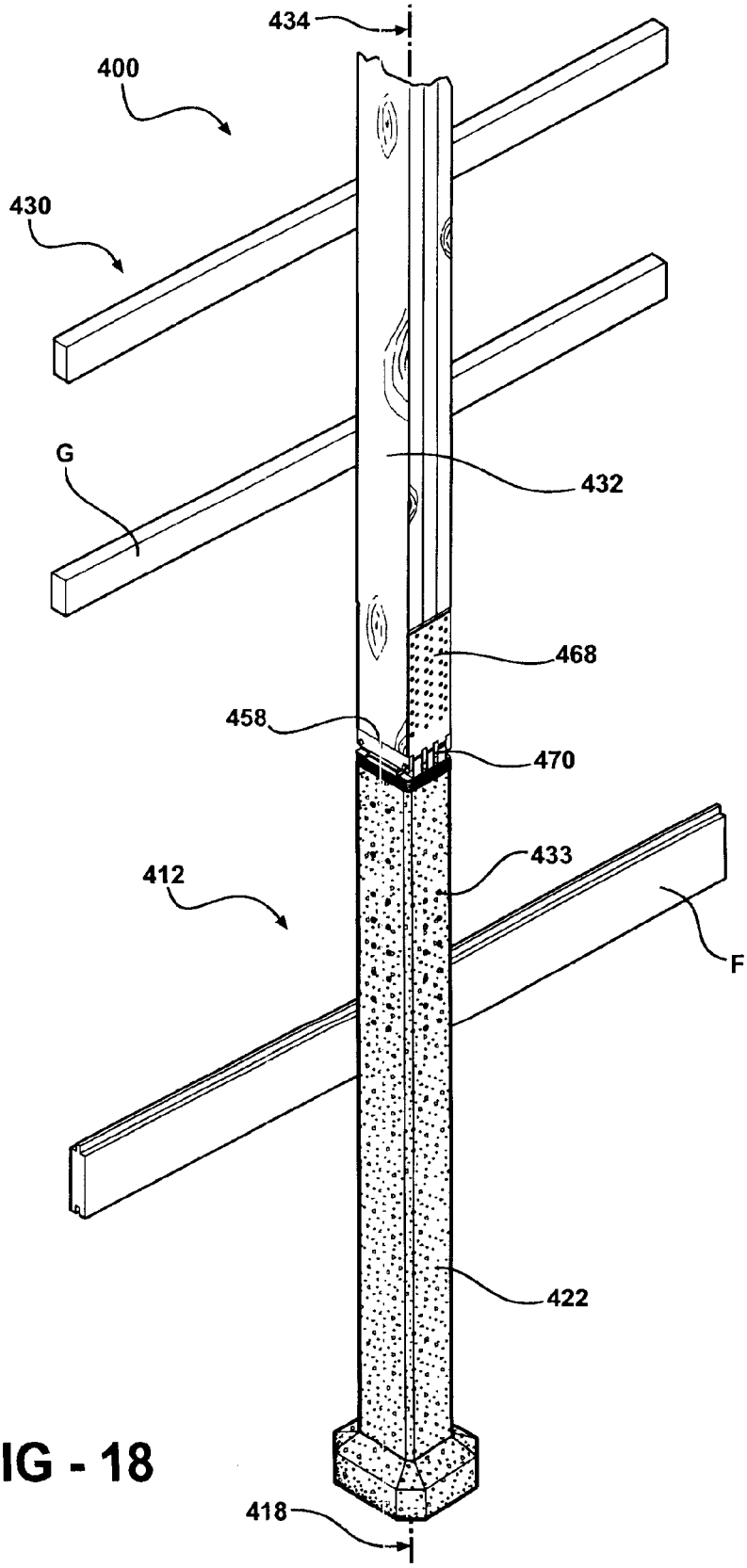
FIG. 18 is a perspective view of the hinged connection between the upper and lower piling for a fourth alternative of a piling assembly with the upper and lower piling in the upright and locked positions.

In the early stages of building construction, the upper and lower hinges 436, 424 are partially interleaved, as shown in FIG. 17, such that only a first pin 444 connects the upper hinge 436 to the lower hinge 424, along the first axis 428, and the second longitudinal axis 434, for the upper piling 430, is at an angle to the first longitudinal axis 418, for the lower piling 412. As a result, the columns 432 for the building can set tilted onto the ground. This position allows wall girts G to be connected to the columns 432 to facilitate the framing of an entire wall, or at least a portion of a wall, at ground level. Once the framing with the wall girts G is completed, the upper pilings 430 that form an entire wall, or a portion of a wall, are hoisted upward as a single unit, pivoting about the first pin 444 on the first axis 428. Then, the upper pilings 430 are hoisted upward, about the first axis 428, until the upper and lower hinges 436, 424 are completely interleaved with one another and the second axes 450, for the upper and lower second holes 452, 448, are aligned. When the hinges 436, 424 are completely interleaved, the first pin 444 is extending through the upper and lower first holes 426, 438, on the first axis 428, to engage and support the hinges 436, 424. Likewise, a second pin 454 is extending through the upper and lower second holes 452, 448, on the second axis 450, to engage and support the hinges 436, 424 when the longitudinal axes 418, 434 are aligned, as shown in FIG. 18.

Each of the upper and lower hinges 436, 424 include a first plurality of hinge knuckles 446, disposed about the first pin 444, where the knuckles 446 of the upper hinge 436 are interleaved with the knuckles 446 of the lower hinge 424. The knuckles 446 hold the first pin 444 in spaced relationship to the upper and lower pilings 430, 412 to transmit longitudinal forces between the pilings 430, 412 through the first pin 444. These forces include the loads resulting from the weight of the wall girts G, the roof, various other building materials and environmental factors. Similarly, the hinges 436, 424 include a second plurality of locking knuckles 456 that are disposed about the second pin 454 with the locking knuckles 456 of the upper hinge 436 interleaved with the locking knuckles 456 of the lower hinge 424. The locking knuckles 456 hold the second pin 454 in spaced relationship to the pilings 430, 412 to transmit longitudinal forces between the pilings 430, 412 totally through the first and second pins 444, 454. Therefore, the pins 444, 454 support the entire load provided by the upper pilings 430, wall girts G, the roof, various other building materials and environmental factors.

Each of the hinges 436, 424 includes a plurality of plates 458 that are in spaced and parallel relationship. A gap 469 is defined between each of the plates 458 to facilitate the upper hinge 436 interleaving with the lower hinge 424. The first hole 426 or 438 is defined through each of the plates 458, along the first axis 428. The second hole 448 or 452 is also defined through each of the plates 458, along the second axis 450, and spaced transversely across each of the plates 458 from the first hole 426 or 438 respectively. Furthermore, the plates 458 define a bottom edge 462 and end edges 464.

The lower hinge 424 is attached to the reinforcing cage 420 of the lower piling 412 along the bottom edge 462 and the holes 426, 448 are in spaced relationship from the lower piling 412. The upper hinge 436 includes a bottom 466 and a pair of opposing walls 468 that extend upward from the bottom 466, along the column 432. The bottom edge 462 of each of the plates 458 are attached to the bottom 466 of the lower hinge 424 and the end edges 464 of each of the plates 458 are attached to the opposing walls 468. Furthermore, the bottom 466 and the opposing walls 468 define a plurality of grooves 470 that extend in spaced and parallel relationship across the bottom 466 and into a portion of the walls 468, between each of the plates 458. The grooves 470 allow the plates 458 of the lower hinge 424 to interleave with the plates 458 of the upper hinge 436.

The next embodiment of the piling assembly 500, shown in FIGS. 19-39, comprises another type of height adjustable lower piling 512, i.e., jack piling assembly, hingedly connected to an upper piling 530. The lower piling 512 has a first end 514, i.e., a top, and a second end 516, i.e., a bottom, with a first longitudinal axis 518 extending therethrough. The upper piling 530 has a column 532 with a second longitudinal axis 534 extending therethrough.

Figure 19:
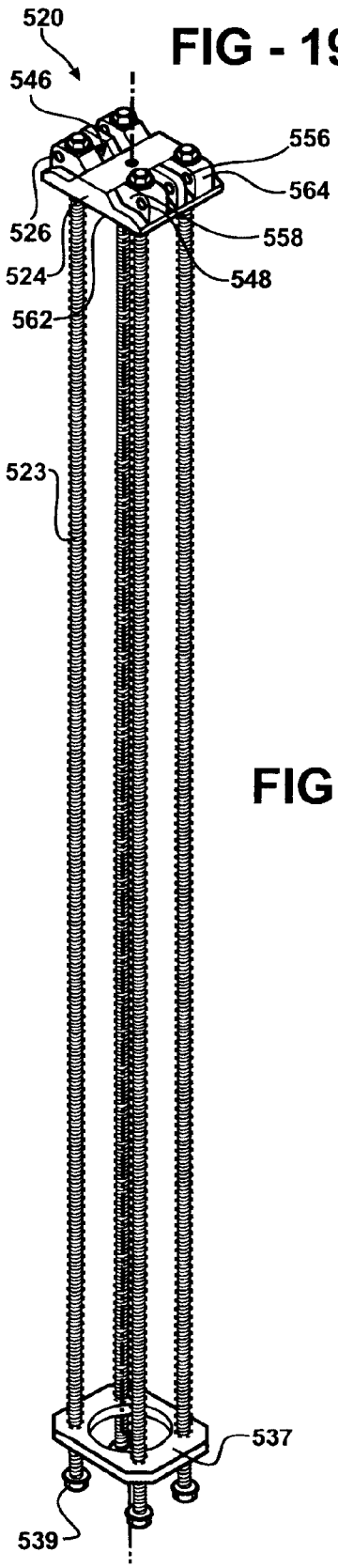
FIG. 19 is a perspective view of a reinforcing cage for a fifth alternative of a piling assembly.
Figure 32:
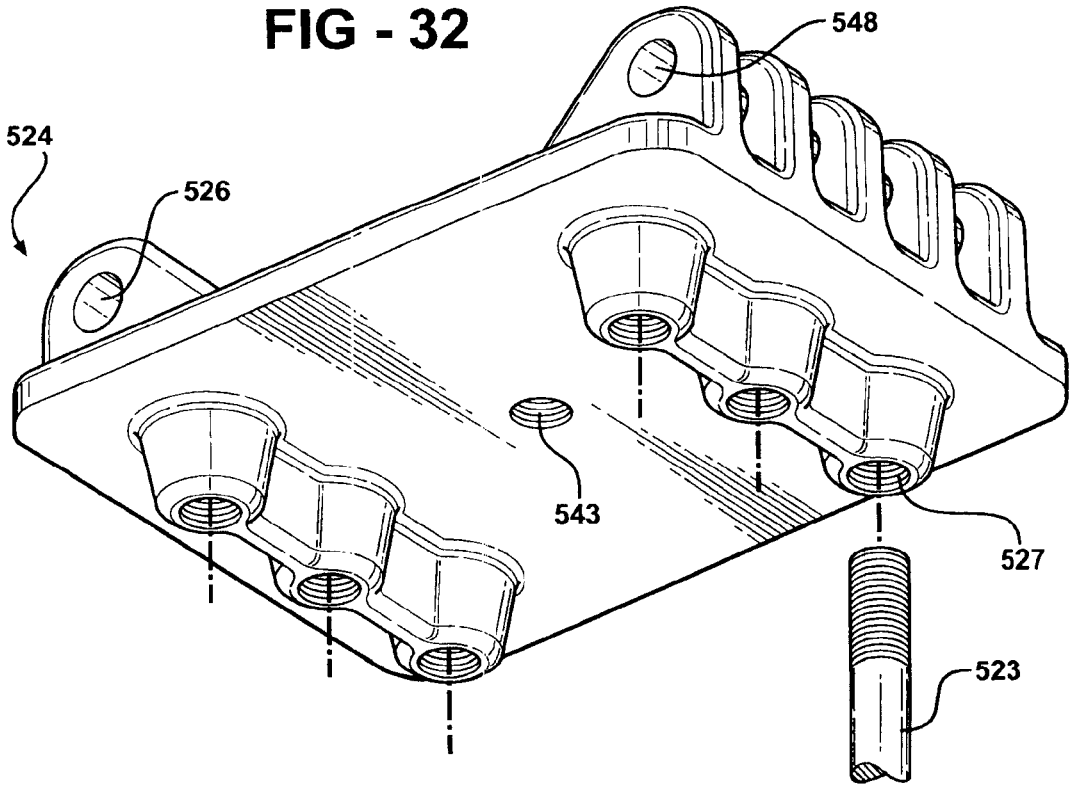
FIG. 32 is a perspective bottom view of a top plate and a top retention device for a fifth alternative of a piling assembly.
Figure 33:
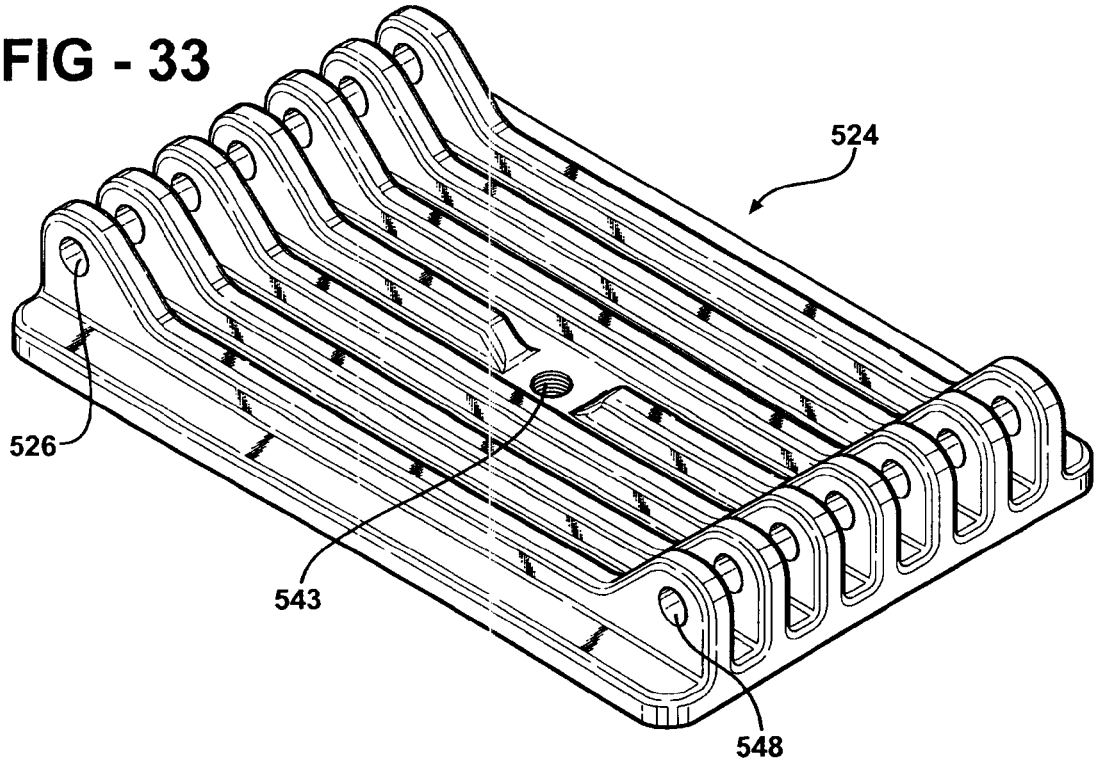
FIG. 33 is a perspective top view of a top plate for a jack piling assembly.
Figure 34:
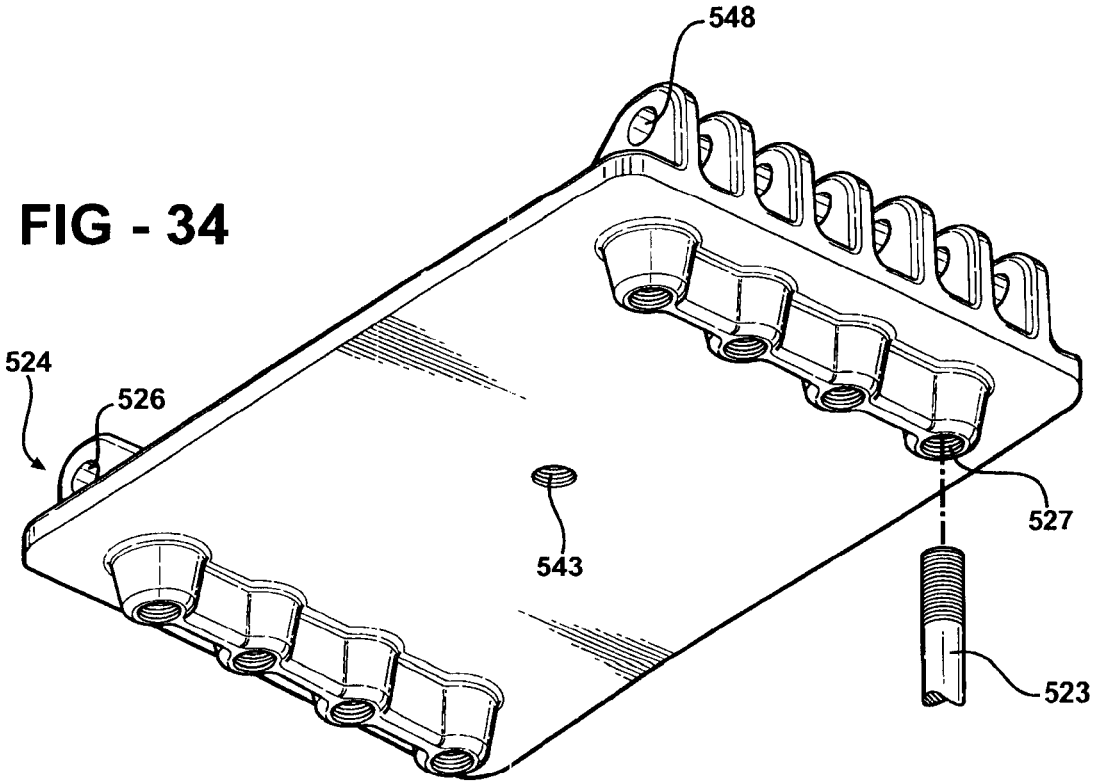
FIG. 34 is a perspective bottom view of a top plate and a top retention mechanism for a fifth alternative of a piling assembly.

This embodiment uses a height adjustable reinforcing cage 520, as shown in FIG. 19. With this type of a height adjustable reinforcing cage 520, concrete 522 is pre-cast into the shape of a lower piling 512 with a plurality of vertically extending holes (not shown), extending between the first and second end 514, 516. These holes can be lined with cast-in-place plastic tubing 521 which allow for the insertion and removal of post-tensioning rods 523 as one way to facilitate height adjustment of the lower piling 512. Prior to shipment to the job site, the vertically threaded post tensioning rods 523 are preferably threaded into threaded bosses 527 that act as upper retention mechanisms disposed on the underside of a lower hinge 524, i.e., top plate, as shown in FIGS. 32 and 34. However, post-tensioning rods 523 can also be inserted through each of a plurality of vertically extending holes (not shown) in the lower hinge 524, at the first end 514, and extending through the vertical holes in the lower piling 512. Additionally, the post tensioning rods 523 extend out of, and beyond, the second end 516 and are inserted through one or more uplift extensions 529 at the second end 516 of the lower piling 512 and secured with a nut or other suitable fastener that act as lower retention mechanisms 547, as shown in FIG. 36. The nuts are then tightened to post-tension the lower piling 512.

Figure 22:
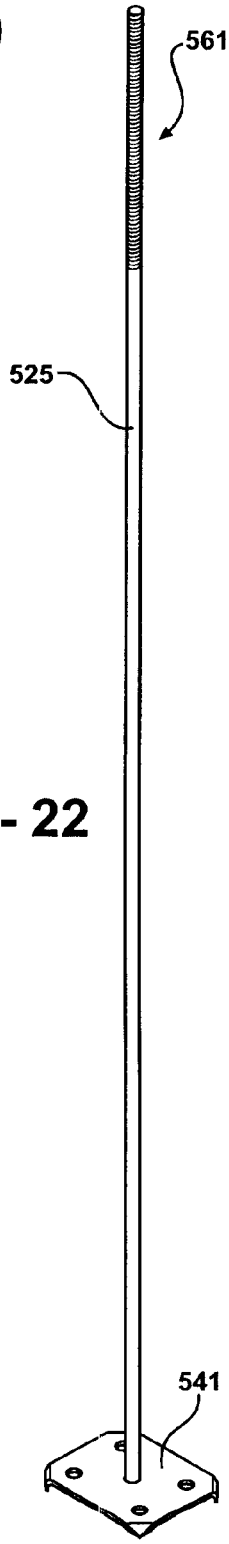
FIG. 22 is a perspective view of a push rod assembly for a fifth alternative of a piling assembly.
Figure 23:
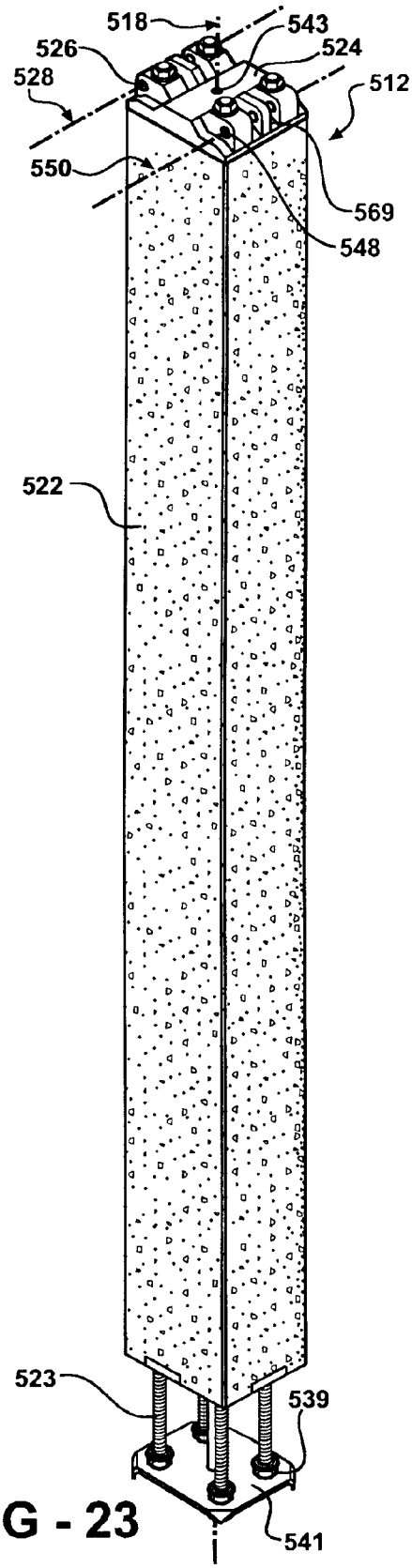
FIG. 23 is a perspective view of an assembled lower reinforcing cage encased in concrete for a fifth alternative of a piling assembly.
Figure 20:
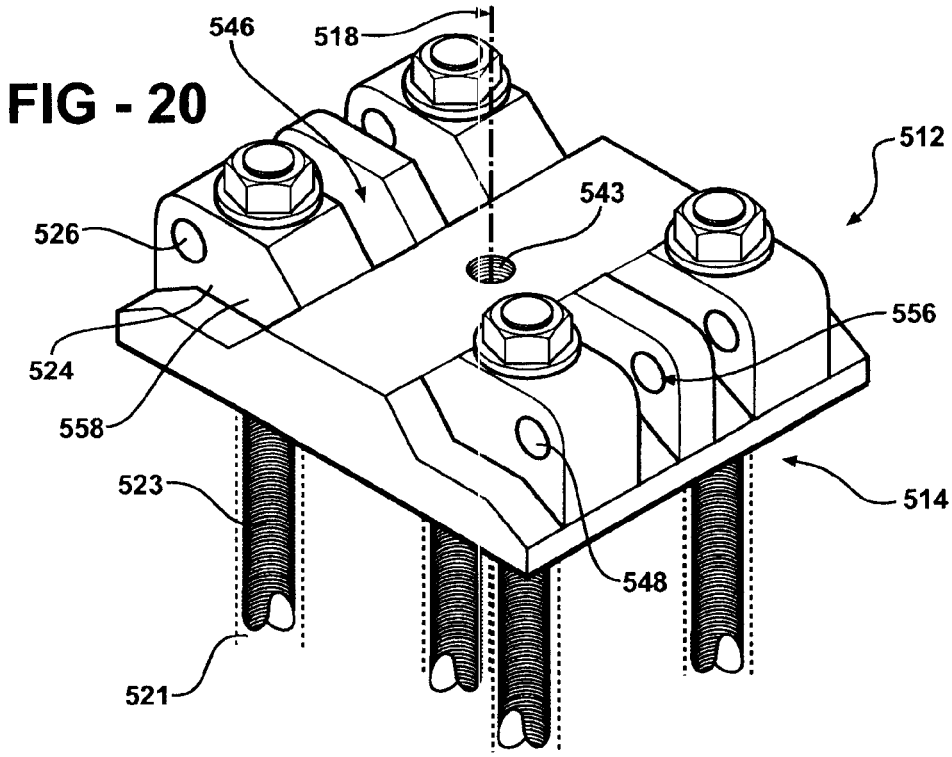
FIG. 20 is a perspective view of a first end of a reinforcing cage for a lower piling for a fifth alternative of a piling assembly.
Figure 21:
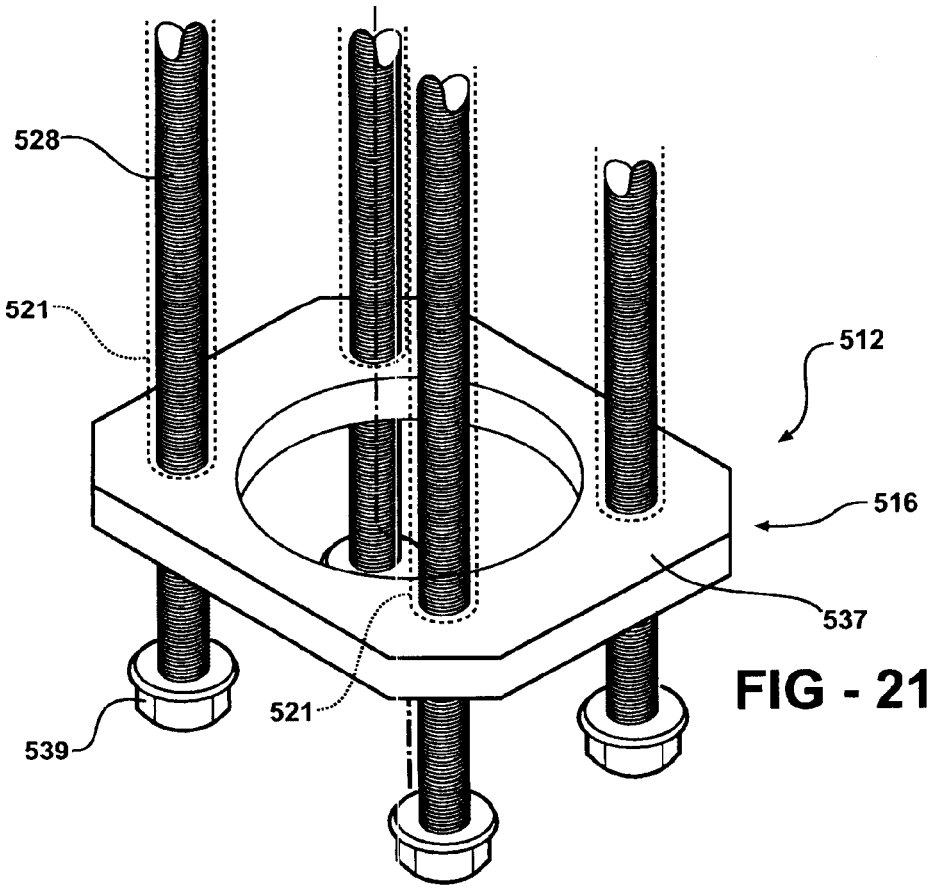
FIG. 21 is a perspective view of a second end of a reinforcing cage for a lower piling for a fifth alternative of a piling assembly.
Figure 24:
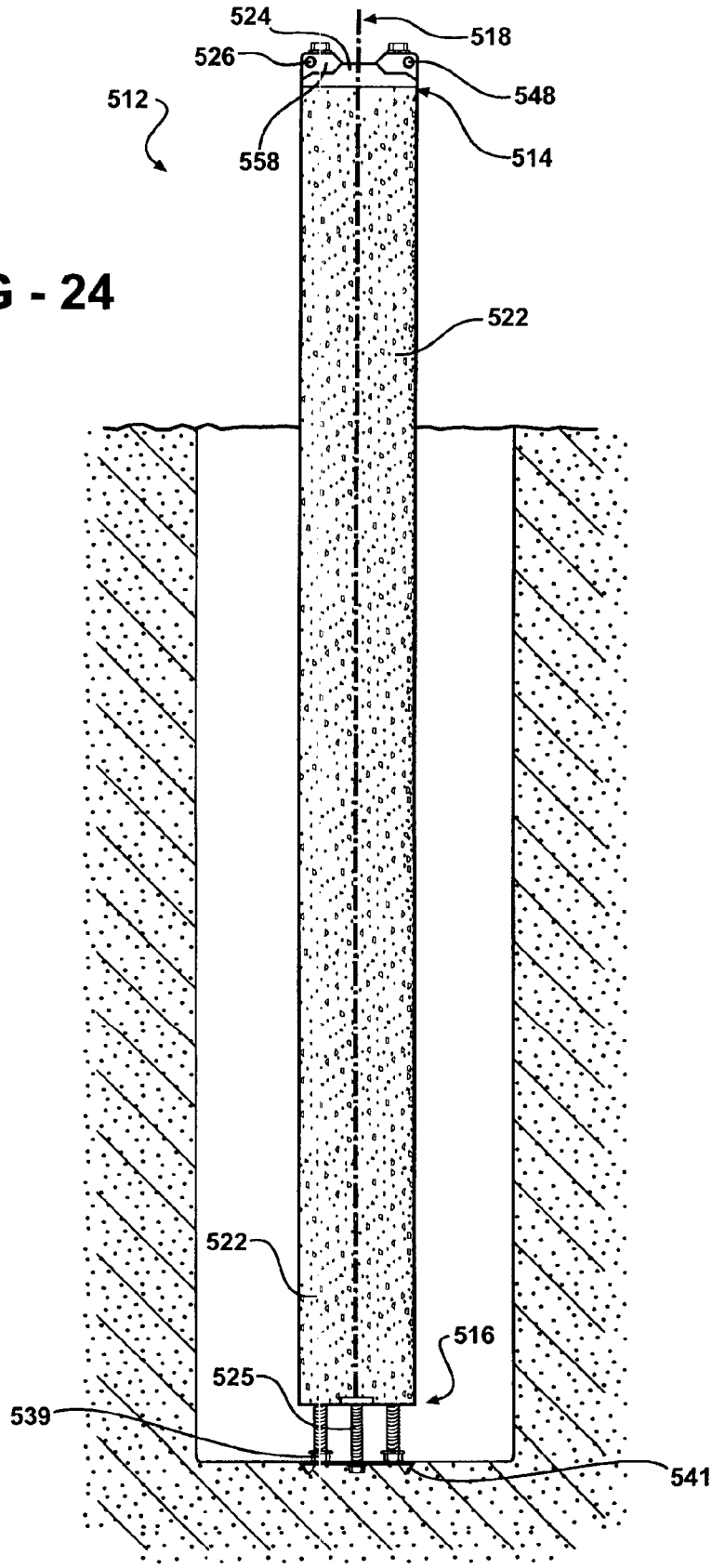
FIG. 24 is a sectional view of a lower piling for a fifth alternative of a piling assembly inserted into the ground with the column in the lowered position.
Figure 25:
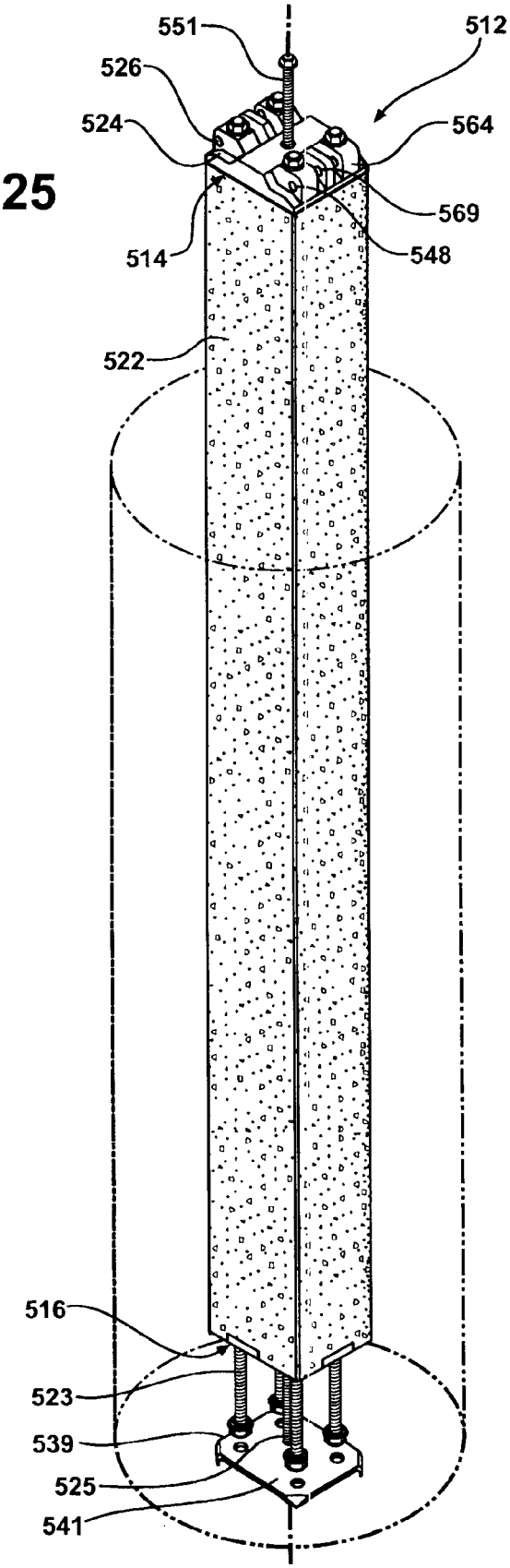
FIG. 25 is a perspective view of a lower piling for a fifth alternative of a piling assembly inserted into the ground with the push rod mechanism threaded into the center hole.
Figure 26:
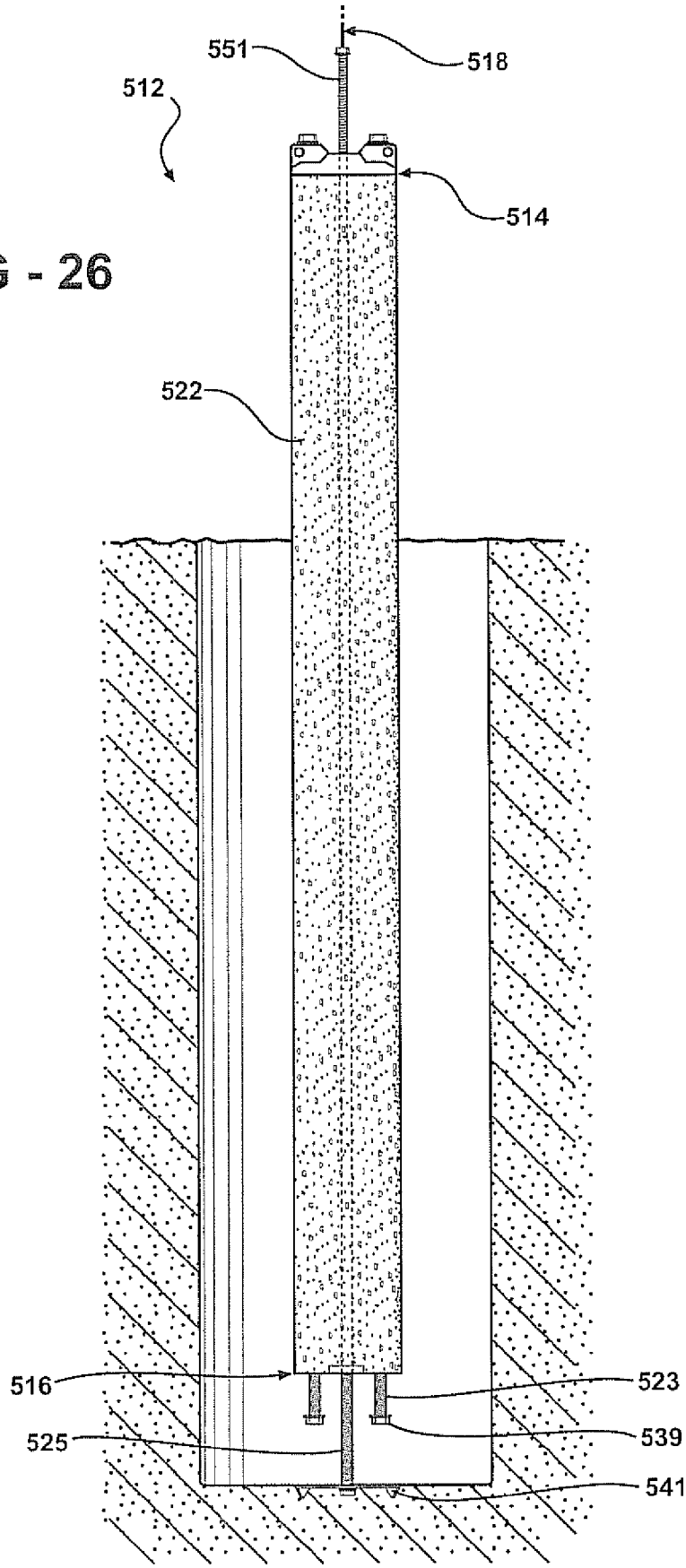
FIG. 26 is a sectional view of a lower piling for a fifth alternative of a piling assembly inserted into the ground with the push rod mechanism threaded into the center hole and the lower piling in the raised position.
Figure 27:
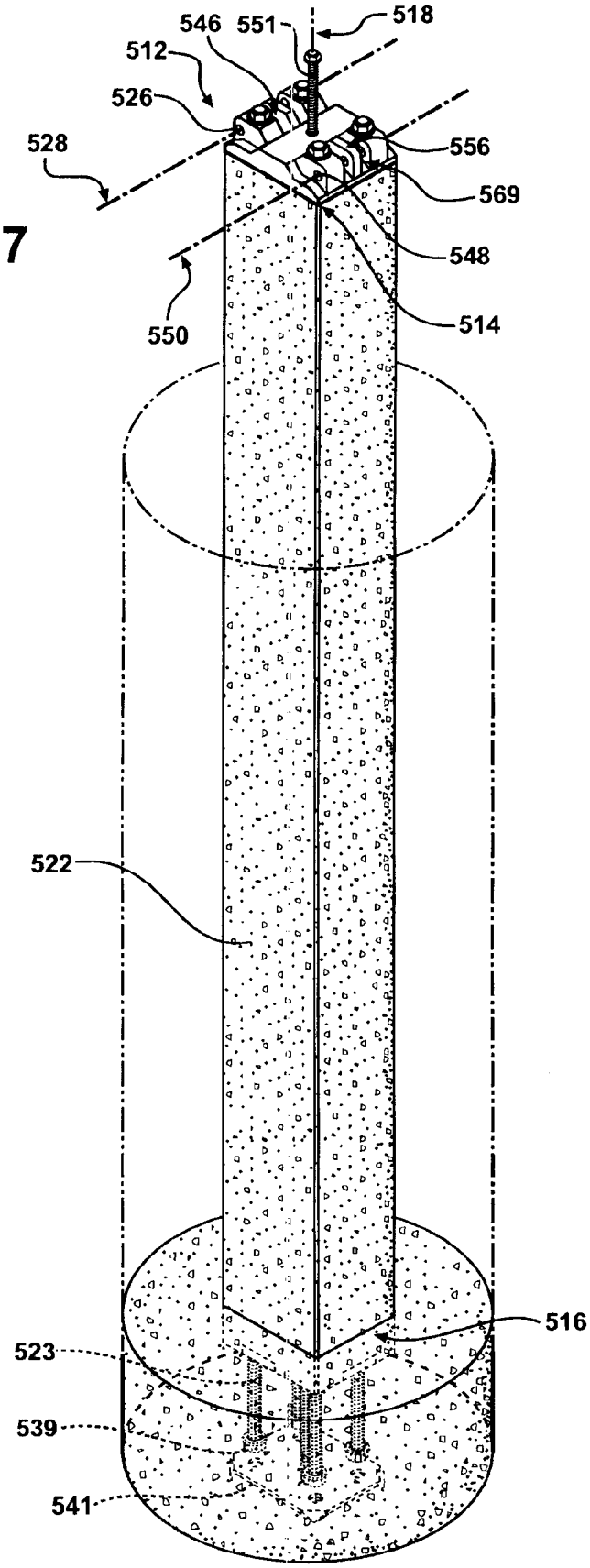
FIG. 27 is a perspective view of a lower piling for a fifth alternative of a piling assembly inserted into the ground with the push rod mechanism threaded into the center hole and the lower piling in the raised position and concrete poured to set the height.
Figure 28:
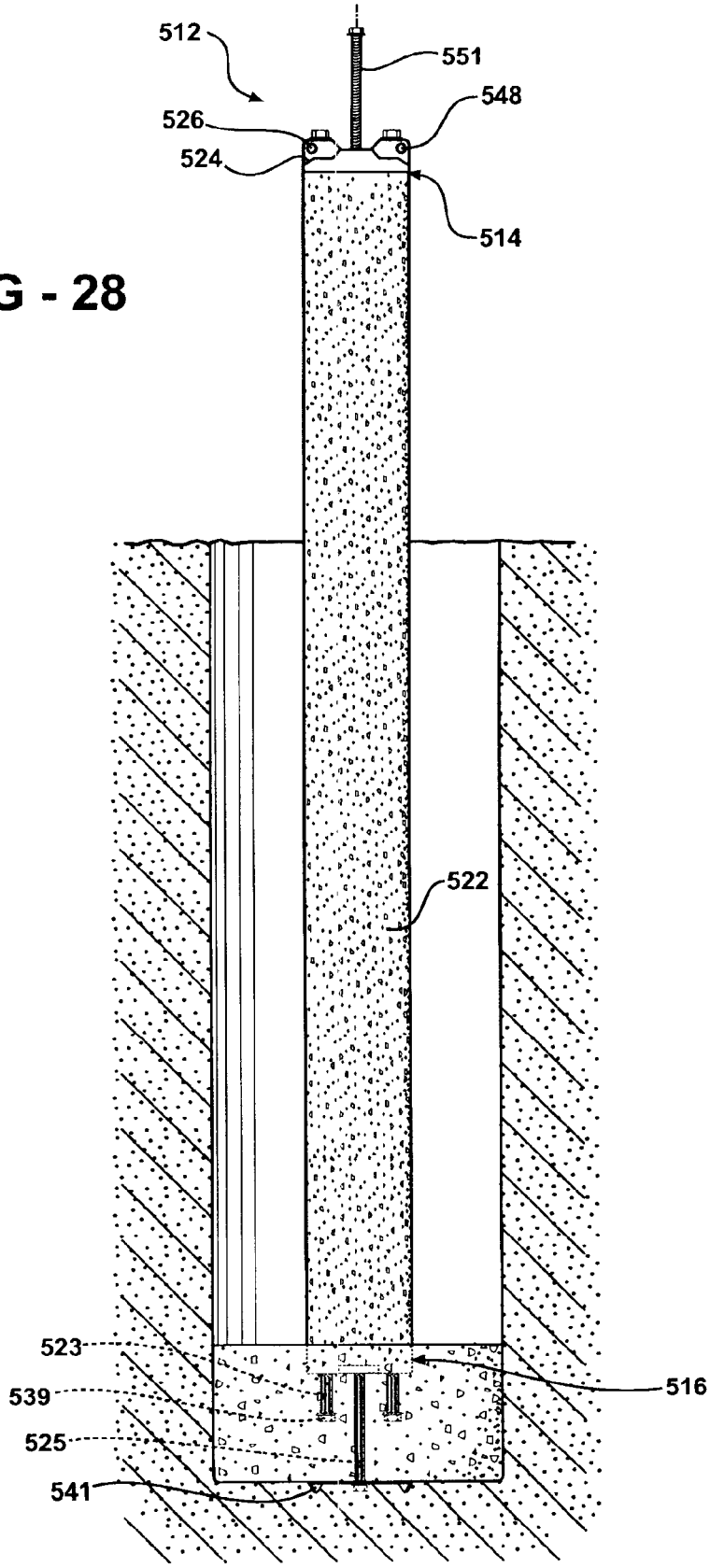
FIG. 28 is a sectional view of a lower piling for a fifth alternative of a piling assembly inserted into the ground with the push rod mechanism threaded into the center hole and the lower piling in the raised position and concrete poured to set the height.

Alternatively, the post-tensioning rods 523 can be threaded through corresponding holes on the base plate 537, each terminating at a flanged nut 539, as shown in FIGS. 21 and 22. When using a base plate 537, flanged nuts 539 that are in spaced relationship to the base plate 537 are used in place of uplift extensions 529. As an alternative to threading the rods 523 through holes in the base plate, the holes in the base plate 537 can be oversized and additional nuts (not shown) can be used to secure the base plate 537 against the second end 516 of the lower piling 512 to post-tension the lower piling.

At the job site for constructing the building, if the height of the lower piling 512 needs to be reduced, the post tensioning rods 523, lower hinge 524 and base plate 537 are initially removed and the concrete 522 is cut to the desired height. Following trimming of the lower piling 512, the rods 523, lower hinge 524 and base plate 537 are reassembled to the lower piling 512.

Additionally, a vertical hole, i.e., passage, (not shown) is cast into center of the concrete 522, extending between the first and second ends 514, 516 and along the first longitudinal axis 518. A vertical push rod 525 is attached to a bearing plate 541 with a nut 577 to create a push rod assembly 561, as shown in FIG. 22. The vertical push rod 525, with the bearing plate 541 attached, is inserted into the center hole of the lower piling 512, from the second end 516. Next, a hole for receiving the bearing plate 541, and a portion of the lower piling 512, is excavated into the earth to a floor, i.e., a surface. A plurality of downward projecting teeth 531 are disposed on the bearing plate 541 for improving the grip between the bearing plate 541 and the floor. Following excavation of the hole in the earth, the second end 516, and a portion of the lower piling 512, with the bearing plate 541 inserted therein, is placed into the hole in the earth and the bearing plate 541 is set onto the floor thereof to support the lower piling 512. Inside of the hole in the earth, the uplift extensions 529 are initially resting on the bearing plate 541. Likewise, if the flanged nuts 539 are used in lieu of the uplift extensions 529, the flanged nuts 539 are initially resting on the bearing plate 541.

To set the overall height of the lower piling 512, a threaded height adjustment mechanism 551, i.e., threaded shaft, having a head 535 disposed at one end thereof, is threadedly inserted through a center hole, i.e., passage, in the first end 514 at a threaded hole 543, i.e., threaded bore, in the lower hinge 524. Torque is applied to the height adjustment mechanism 551, via the head 535, to thread the height adjustment mechanism 551 into the lower piling 512 until the height adjustment mechanism 551 abuts the push rod. As torque is continued to be applied to the head 535, the mechanism 551 pushes against the push rod 525 of the push rod assembly 561, forcing the lower piling 512, and thus the uplift extensions 529 or flanged nuts 539, to move upward and away from the bearing plate 541. Once the desired height for the lower piling 512 is attained, concrete is poured into the hole in the earth, stopping at least two inches above the uplift extensions 529, and/or the base plate 537, to prevent the lower piling 512 from lifting out of the hole in the earth and to prevent the base plate 537 and/or the uplift extensions 529 from corroding. Once the concrete in the hole in the earth is adequately set, the height adjustment mechanism 551 is unthreaded and removed from the center hole in the lower piling 512. Finally, the hole in the earth is back filled with dirt, concrete or any other suitable material.

However, the jack piling assembly 512 is not limited to a post-tensioned concrete 522. A reinforced concrete 122, 222, 322, 422, such as those described in the previous four embodiments, or a pre-tensioned concrete can be used in lieu of post-tensioned concrete if they have a vertical hole, cast in the center along the first longitudinal axis 518, to facilitate height adjustment using the height adjustment mechanism 551 and the push rod assembly 561.

To provide an attachment scheme for the upper piling 530, the lower hinge 524, i.e., top plate, extends from the first end 514 and defines at least one lower first hole 526 on a hinge axis 528 that is spaced from the first end 514. The upper piling 530 has a column 532 and a second longitudinal axis 534 extending therethrough. Typically, the column 532 is comprised of wood, steel, aluminum or a composite. The upper hinge 536 extends from the column 532 and defines at least one upper first hole 538 on the hinge axis 528. The lower hinge 524 also defines a lower second hole 526, on a second axis 550 which is spaced transversely across the lower piling 512 from the lower first hole 550 and spaced from the first end 514. The upper hinge 536 also defines an upper second hole 552, on the second axis 550, which is spaced transversely across the upper piling 530 from the upper first hole 538.

Figure 29:
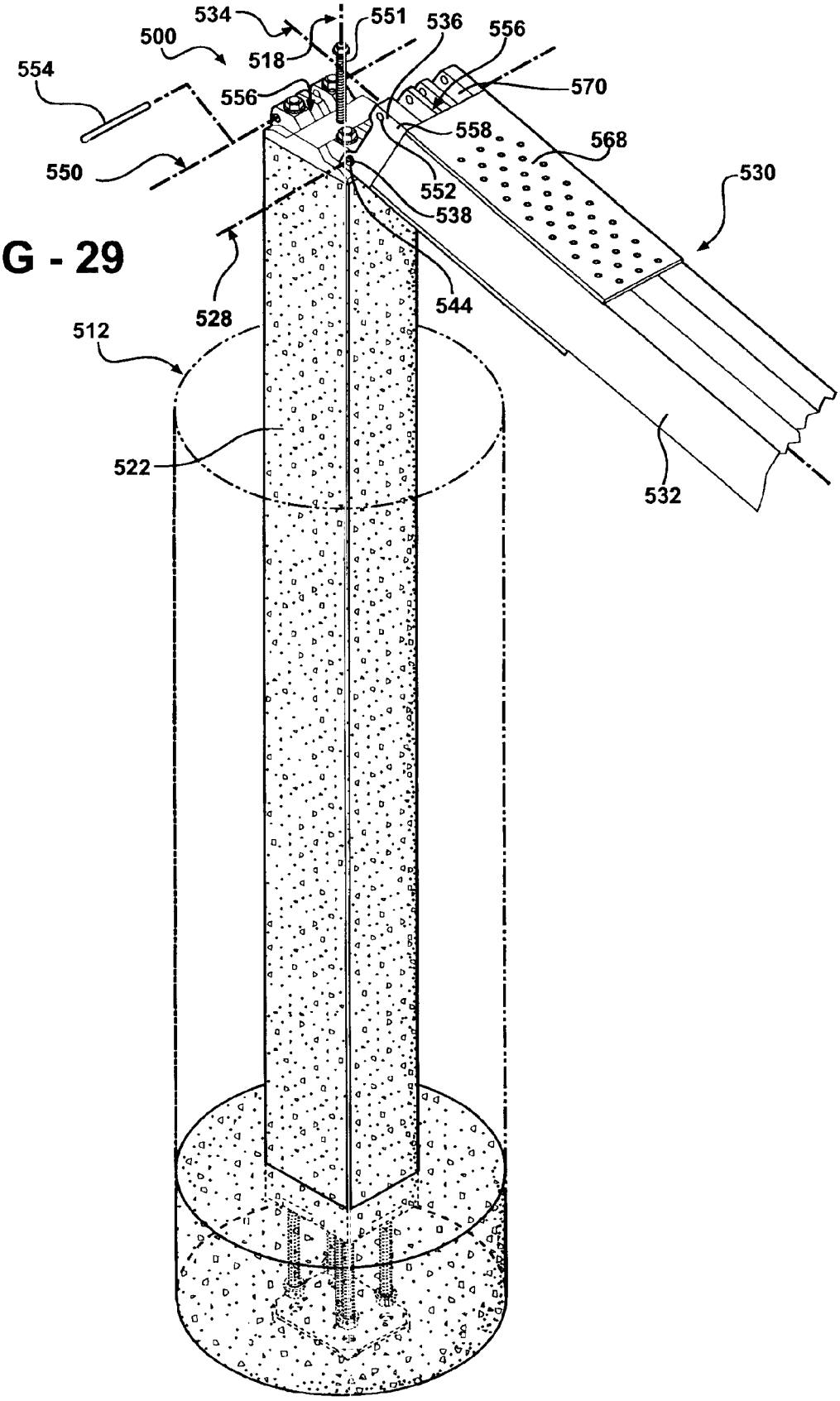
FIG. 29 is a perspective view of a lower piling assembly for a fifth alternative of a piling assembly set into the ground in the raised position with the upper piling tilted away from the lower piling about a pin.
Figure 30:
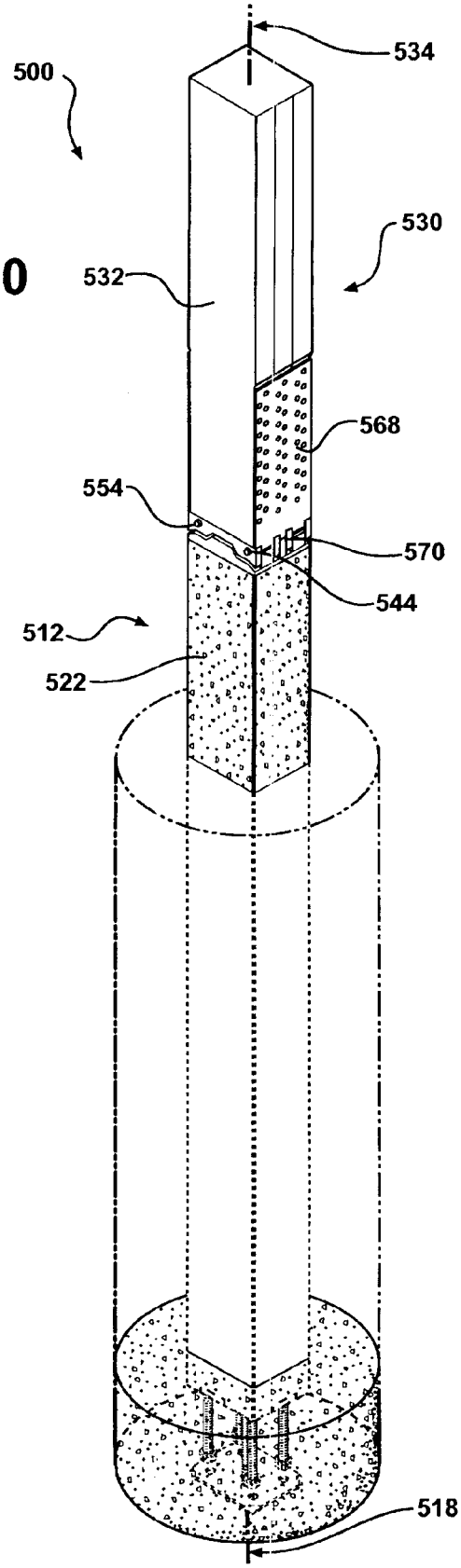
FIG. 30 is a perspective view of a lower piling assembly for a fifth alternative of a piling assembly set into the ground in the raised position with the upper and lower pilings in the upright and locked positions.
Figure 31:
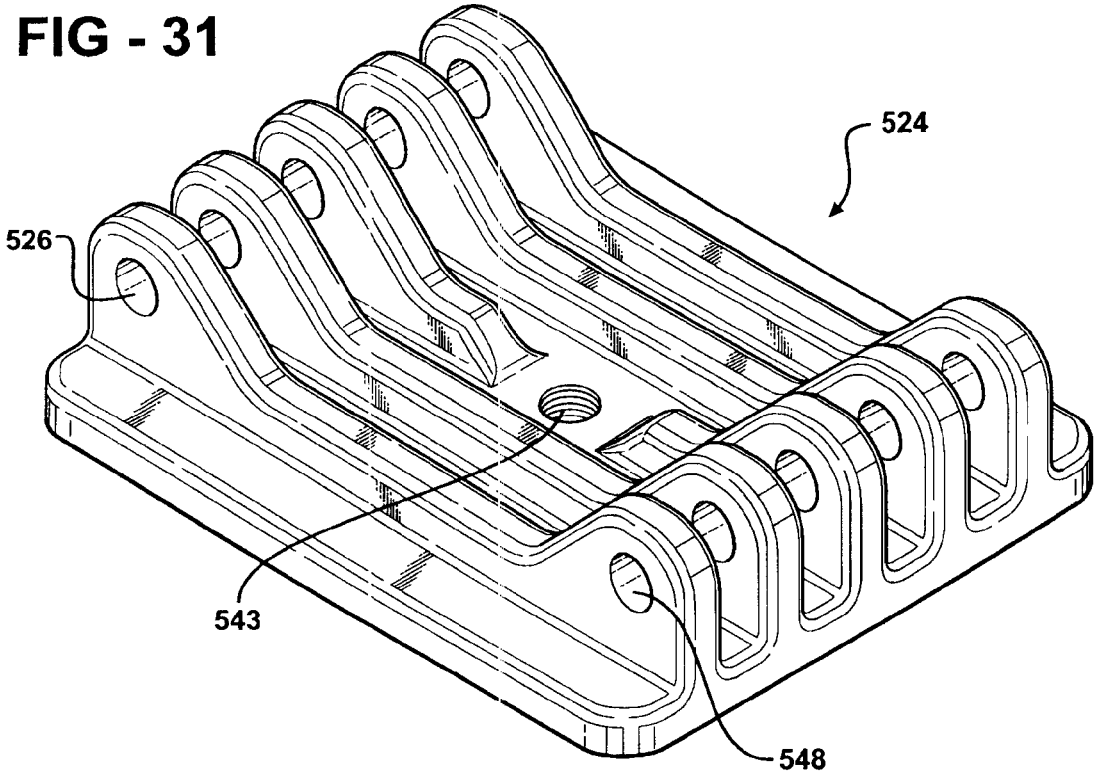
FIG. 31 is a perspective top view of a top plate for a fifth alternative of a piling assembly.

In the early stages of building construction, the upper and lower hinges 536, 524 are partially interleaved, as shown in FIG. 29, such that only a first pin 544 connects the upper hinge 536 to the lower hinge 524, along the hinge axis 528, i.e., hinge axis, and the second longitudinal axis 534, for the upper piling 530, is at an angle to the first longitudinal axis 518, for the lower piling 512. As a result, the columns 532 for the building can set tilted onto the ground. This position allows wall girts G to be connected to the columns 532 to facilitate the framing of an entire wall, or at least a portion of a wall, at ground level. Once the framing with the wall girts G is completed, the upper pilings 530 that form an entire wall, or a portion of a wall, are hoisted upward as a single unit, pivoting about the first pin 544 on the hinge axis 528. Then, the upper pilings 530 are hoisted upward, about the hinge axis 528, until the upper and lower hinges 536, 524 are completely interleaved with one another and the second axes 550, for the upper and lower second holes 552, 548, are aligned. When the hinges 536, 524 are completely interleaved, the first pin 544 is extending through the upper and lower first holes 548, 538, on the hinge axis 528, to engage and support the hinges 536, 524. Likewise, a second pin 554 is extending through the upper and lower second holes 552, 526, on the second axis 550, to engage and support the hinges 536, 524 when the longitudinal axes 518, 534 are aligned, as shown in FIG. 30.

Each of the upper and lower hinges 536, 524 include a first plurality of hinge knuckles 546, disposed about the first pin 544, where the knuckles 546 of the upper hinge 536 are interleaved with the knuckles 546 of the lower hinge 524. The knuckles 546 hold the first pin 544 in spaced relationship to the upper and lower pilings 530, 512 to transmit longitudinal forces between the pilings 530, 512 through the first pin 544. These forces include the loads resulting from the weight of the wall girts G, the roof, various other building materials and environmental factors. Similarly, the hinges 536, 524 include a second plurality of locking knuckles 556 that are disposed about the second pin 554 with the locking knuckles 556 of the upper hinge 536 interleaved with the locking knuckles 556 of the lower hinge 524. The locking knuckles 556 hold the second pin 554 in spaced relationship to the pilings 530, 512 to transmit longitudinal forces between the pilings 530, 512 totally through the first and second pins 544, 554. Therefore, the pins 544, 554 support the entire load provided by the upper pilings 530, wall girts G, the roof, various other building materials and environmental factors.

Each of the hinges 536, 524 includes a plurality of plates 558 that are in spaced and parallel relationship. A gap 569 is defined between each of the plates 558 to facilitate the upper hinge 536 interleaving with the lower hinge 524. The first hole 526 or 538 is defined through each of the plates 558, along the first axis 550. The second hole 548 or 552 is also defined through each of the plates 558, along the second axis 528, and spaced transversely across each of the plates 558 from the first hole 526 or 538 respectively. Furthermore, the plates 558 define a bottom edge 562 and end edges 564.

The lower hinge 524 is attached to the lower piling 512 at the bottom edge 562 and the holes 526, 548 are in spaced relationship from the lower piling 512. The upper hinge 536 includes a bottom 566 and a pair of opposing walls 568 that extend upward from the bottom 566, along the column 532. The bottom edge 562 of each of the plates 558 are attached to the bottom 566 of the upper hinge 536 and the end edges 564 of each of the plates 558 are attached to the opposing walls 568. Furthermore, the bottom 566 and the opposing walls 568 define a plurality of grooves 570 that extend in spaced and parallel relationship across the bottom 566 and into a portion of the walls 568, between each of the plates 558. The grooves 570 allow the plates 558 of the lower hinge 524 to interleave with the plates 558 of the upper hinge 536.

Additionally, a plurality of thru-holes 533 can be pre-cast into the concrete 522 to facilitate attachment of various framing pieces F, concrete anchors, etc. to the lower piling 512.

A wall for a building can be constructed when more than one piling 512 is installed into holes in the earth at a building site. The method of erecting a wall for a building using a jack piling 512, i.e., lower piling, having a top and a bottom and a second piling 512 having a top and a bottom, comprises the steps of excavating a first hole and a second hole in the surface of the earth to a floor in each hole, placing the bottom of the jack piling 512 having a hinge axis 528 at the top onto the floor in the first hole, and placing the bottom of the second piling 512 having a hinge axis 528 at the top onto the floor in the second hole.

Then, the method includes the step of adjusting the position of the bottom of the second piling 512 upwardly and away from the floor of the second hole to establish the position of the hinge axis 528 of the second piling 512 prior to adjusting the position of the bottom of the jack piling 512. Next, the method includes the step of adjusting the position of the bottom of the jack piling 512 upwardly and away from the floor of the first hole to bring the hinge axis 528 of the jack piling 512 upwardly and into alignment with the hinge axis 528 of the second piling 512. The placement of jack pilings 512 into the earth is repeated until the preferred number of pilings 512 for a single wall is achieved.

Figures 35, 36A:
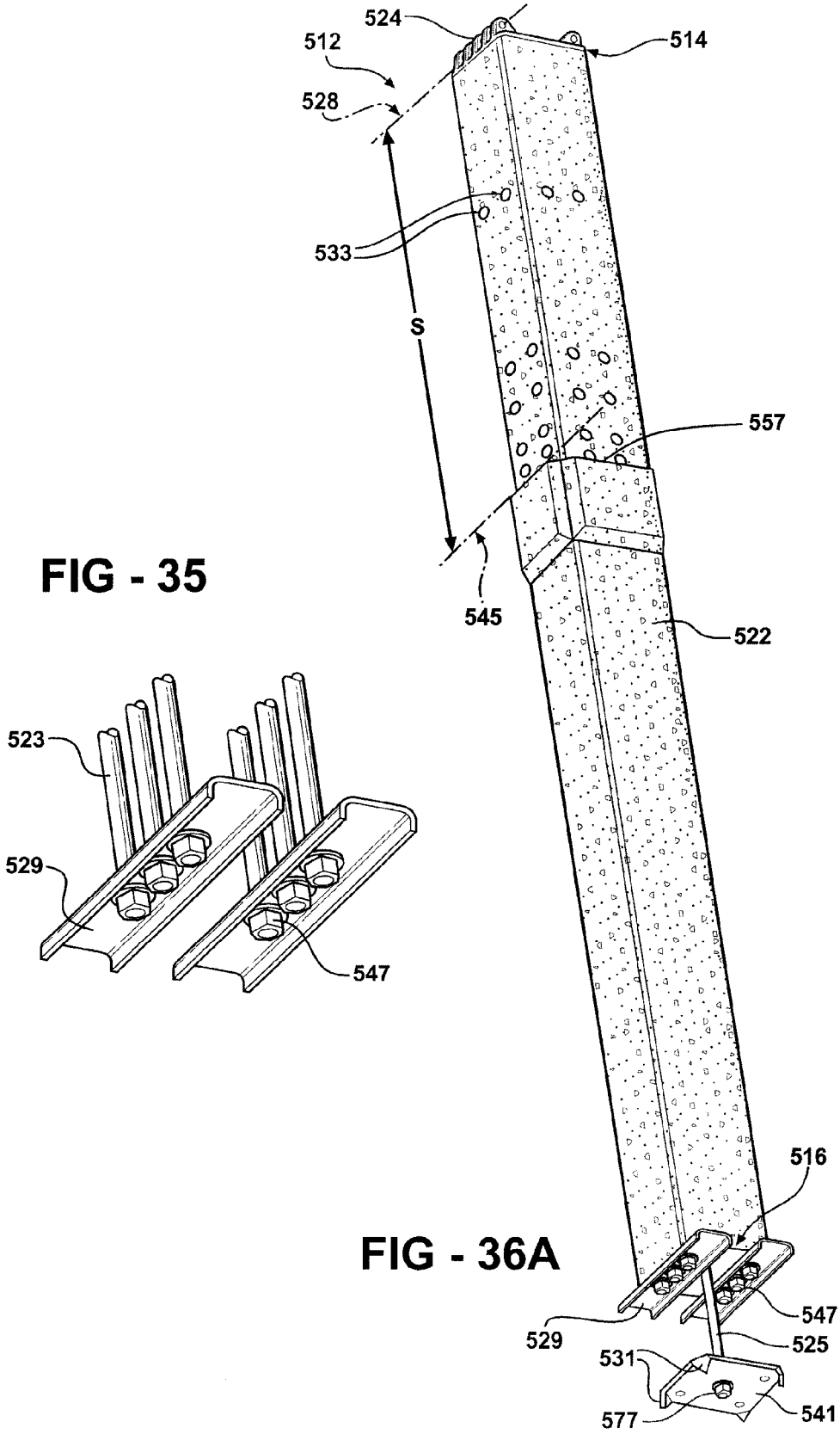
FIG. 35 is a perspective view of uplift extensions and a bottom retention mechanism for a fifth alternative of a piling assembly.
FIGS. 36A, 36B, and 36C are perspective bottom views of a jack piling assembly having a push rod extending into a piling for a fifth alternative of a piling assembly.
Figure 36B:
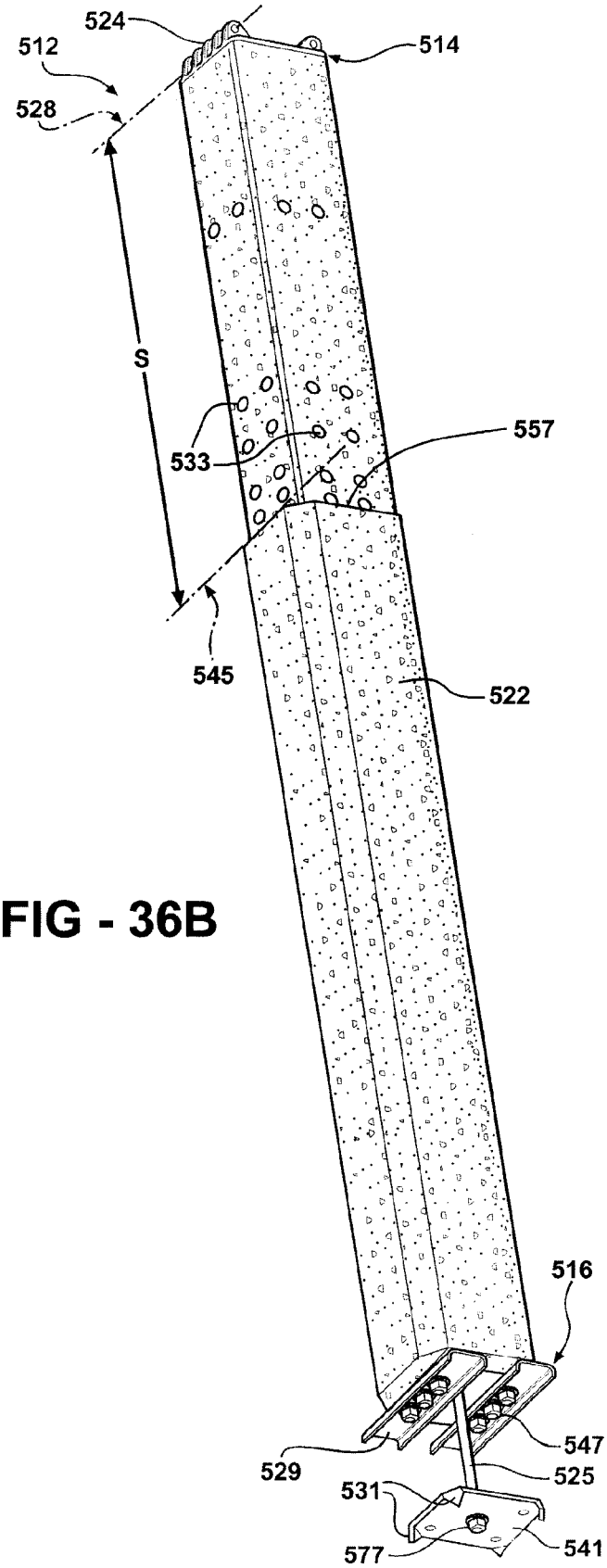
Figure 36C:
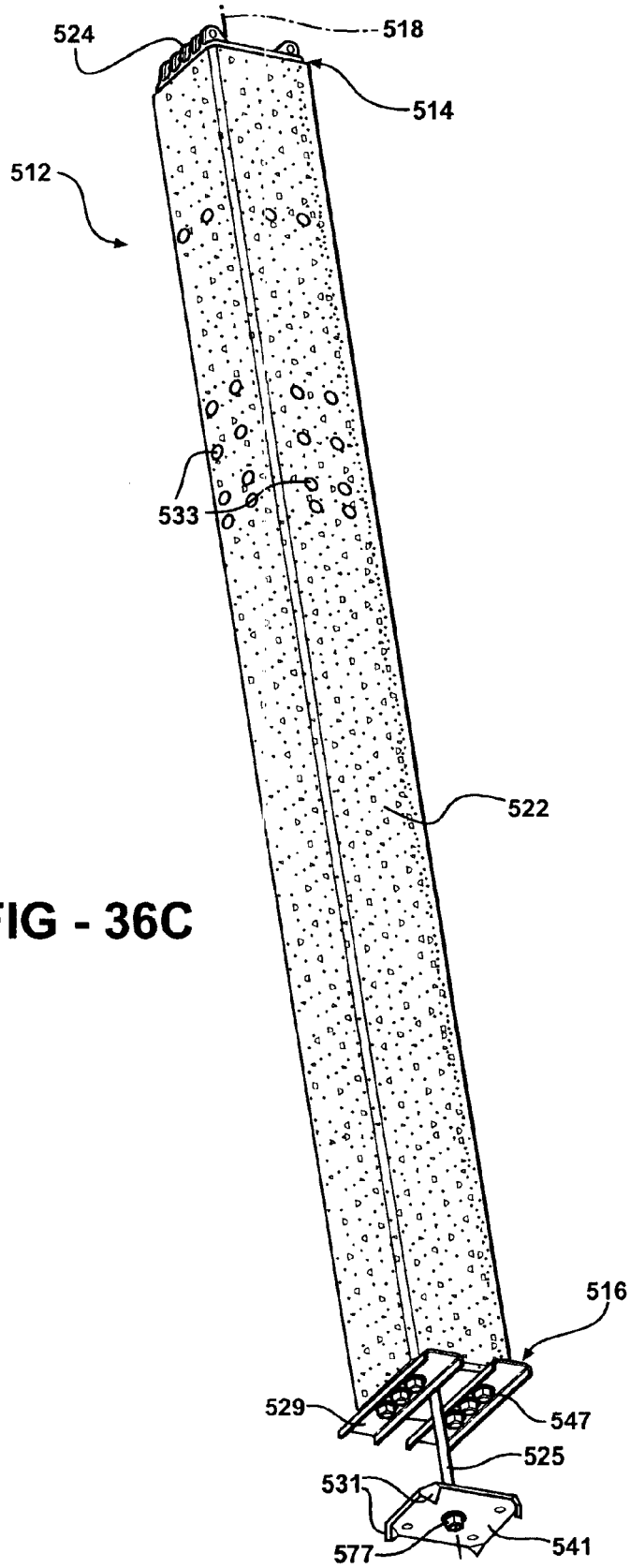
Figure 37:
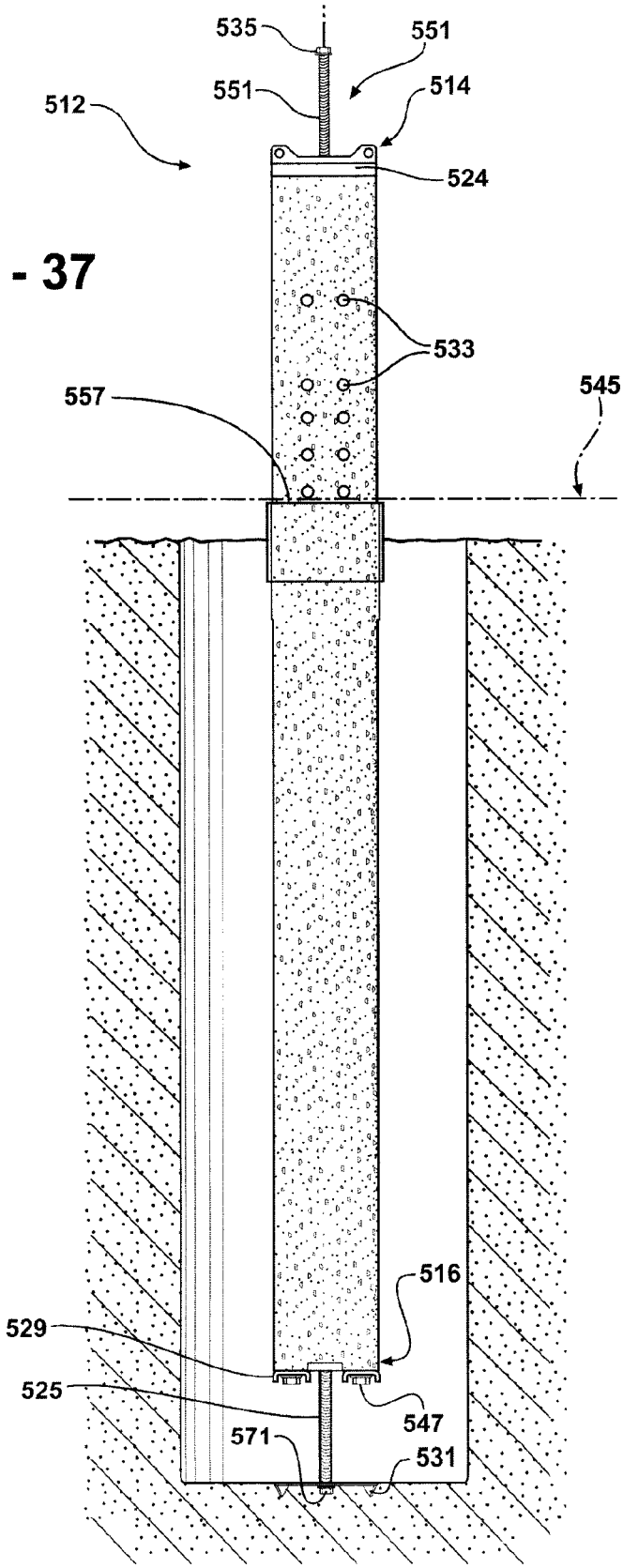
FIG. 37 is a partial sectional view of a lower piling for a fifth alternative of a piling assembly inserted into the ground with the column in the raised position and the grade axis set to a theoretical final grade of the surface of the earth.
Figure 38:
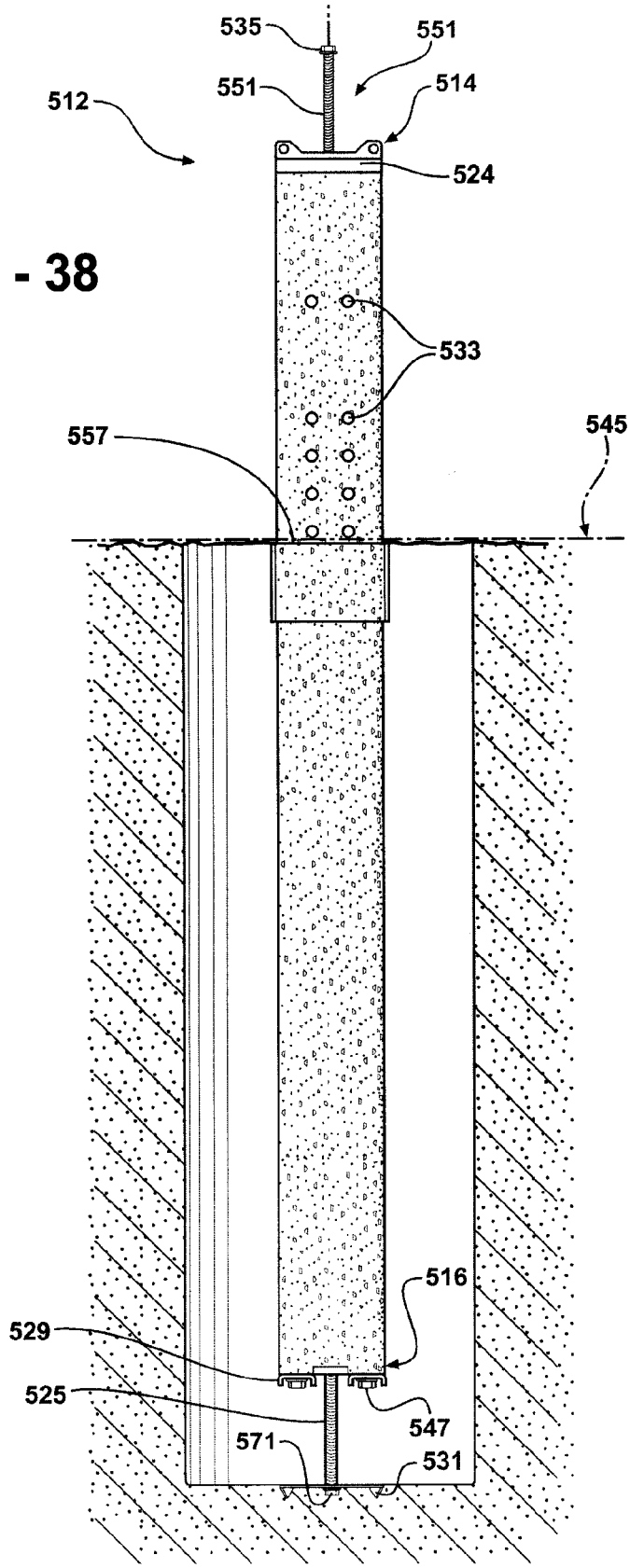
FIG. 38 is a partial sectional view of a lower piling for a fifth alternative of a piling assembly inserted into the ground with the column in the raised position and the grade axis is aligned with a final grade of the surface of the earth.
Figure 39:
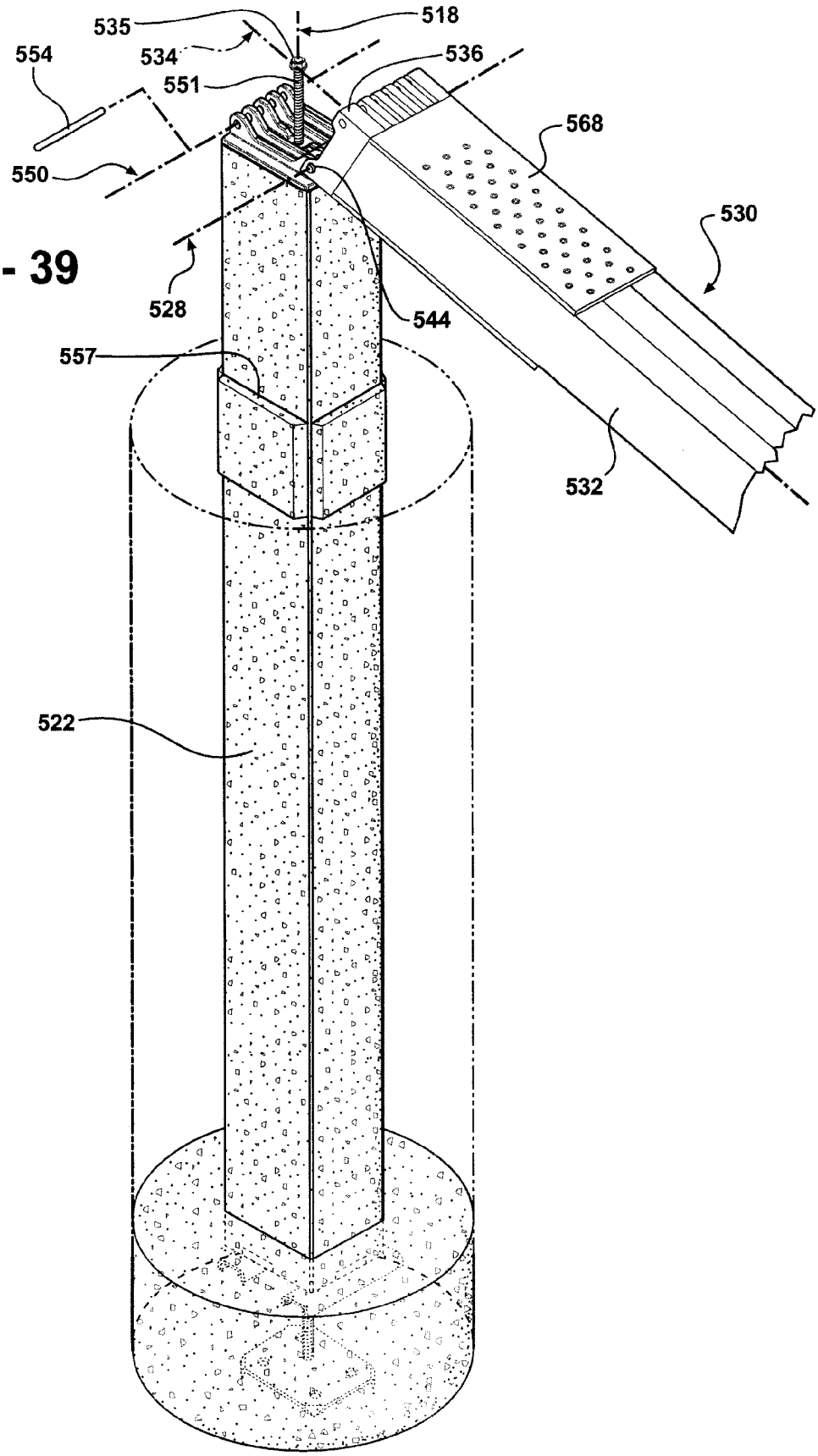
FIG. 39 is a perspective view of a lower piling assembly for a fifth alternative of a piling assembly set into the ground in the raised position with the upper piling tilted away from the lower piling about a pin.
Figure 40:
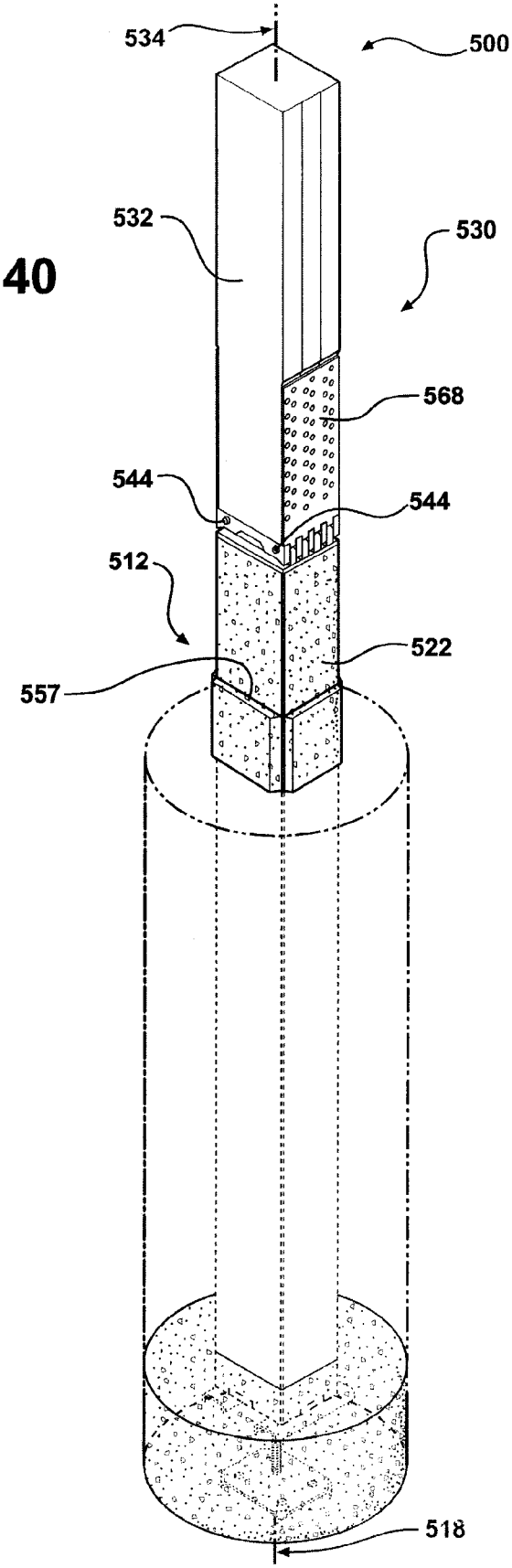
FIG. 40 is a perspective view of a lower piling assembly for a fifth alternative of a piling assembly set into the ground in the raised position with the upper and lower pilings in the upright and locked positions.

One way to determine whether the proper height of each lower 512 piling is achieved is by using a grade ledge 557 that can be integrated onto each of the lower pilings 512, as shown in FIGS. 36A and 36B. The grade ledge 557 provides a ledge on the lower piling 512 for supporting the lowermost framing piece F. When using the jack piling assembly, the grade ledge 557 provides a fixed span between the hinge axis 528 and the grade level 545. When the surface of the earth at the building site is initially graded, it is graded to a theoretical grade FIG. 37. However, when the final grade of the surface of the earth is performed, the surface is graded to a grade level 545, along axis, as shown in FIG. 38. The lower pilings 512 are therefore adjusted to set the grade ledge 557 in alignment with what the grade level 545 will be after the final grade is performed. Likewise, the hinge axes 528 of the lower pilings 512 will be along a common hinge axis 528 by virtue of the fixed span S.

Next, the method includes the step of pouring concrete into each of the holes in the earth to encase a portion of each of the pilings and to fix the alignment of the axes. It is preferable that the concrete extend at least two inches above the uplift extensions 529 to prevent lifting of the lower piling 512 and to prevent corrosion of the uplift extensions 529.

Next, the method includes the step of back filling each of the holes in the earth to the grade level 545 with a fill material. Then the method includes the step of regrading the surface of the earth to be level with a grade level 545. The grade level 545 is usually even with the grade axis of the lower pilings 512.

Then, the method includes the step of pivotally connecting a hinge axis 528 of an upper piling 530, to the hinge axis 528 of the lower piling 512 for each of the lower pilings 512. The next steps of the method include attaching framing pieces F across the upper pilings 530 to form an upper wall and pivoting the upper wall about the hinge axis 528 and into an upright position. Next, the method includes the step of securing the upper wall into the upright position.

Finally, the method includes the step of attaching framing pieces F across the lower pilings 512 to form a lower wall. The use of a grade level 545 on each lower piling 512 can be useful because the grade levels 545 can act as a ledge to align and support the lowermost framing pieces that are attached to the lower pilings 512.

Obviously, many modifications and variations of the present invention are possible in light of the above teachings. In addition, the reference numerals in the claims are merely for convenience and are not to be read in any way as limiting.

What is claimed is:

1. A method of erecting a wall for a building using at least one jack piling including a top having a hinge and defining a vertical threaded bore therethrough and a bearing plate having a stationary member extending vertically through the jack piling and moveable relative to the top of the jack piling, with a threaded height adjustment mechanism, said method comprising the steps of:

excavating at least one hole in the surface of the earth to a floor;

placing the bearing plate of the at least one jack piling onto the floor in the at least one hole;

threading the threaded height adjustment mechanism into the vertical threaded bore of the top of the jack piling to engage the stationary member in abutting engagement; and rotating the threaded height adjustment mechanism relative to the top of the jack piling and against the stationary member after placement of the at least one jack piling in the at least one hole to move the top of the jack piling relative to the bearing plate of the jack piling to bring the hinge of the at least one jack piling into vertical alignment with a hinge axis.

2. A method of erecting a wall as set forth in claim 1 further including the step of pouring concrete into the at least one hole in the earth to form a footing portion of the at least one jack piling about the bearing plate and a portion of the stationary member within the at least one hole and to fix the alignment of the hinge axis.

3. A method of erecting a wall for a building as set forth in claim 2 further including the step of removing the threaded height adjustment mechanism after forming the footing portion within the at least one hole.

4. A method of erecting a wall as set forth in claim 2 further including the step of pivotally connecting a hinge axis of an upper piling to the hinge axis of the lower piling for each of the at least one jack pilings.

5. A method of erecting a wall as set forth in claim 4 further including the step of attaching framing pieces across the upper pilings to form an upper wall.

6. A method of erecting a wall as set forth in claim 5 further including the step of pivoting the upper wall about the hinge axis and into an upright position.

7. A method of erecting a wall as set forth in claim 6 further including the step of securing the upper wall into the upright position.

8. A method of erecting a wall as set forth in claim 7 further including the step of attaching framing pieces across the lower pilings to form a lower wall.

9. A method of erecting a wall as set forth in claim 3 further including the step of back filling each of the at least one holes in the earth to a grade with a fill material.

10. A method of erecting a wall as set forth in claim 9 further including the step of regrading the surface of the earth to be level with the grade level.

11. A method as set forth in claim 1 wherein the step of rotating the threaded height adjustment mechanism relative to the top of the jack piling is further defined as threading the threaded height adjustment mechanism into or out of the threaded bore of the top of the jack piling to move the top of the jack piling vertically up or down respectively.

* * * * *